US006708490B2

(12) United States Patent
Toji et al.

(10) Patent No.: US 6,708,490 B2
(45) Date of Patent: Mar. 23, 2004

(54) HYDRAULIC SYSTEM FOR CONSTRUCTION MACHINE

(75) Inventors: Yutaka Toji, Hiroshima (JP); Hidekazu Oka, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 38 days.

(21) Appl. No.: 10/224,503

(22) Filed: Aug. 21, 2002

(65) Prior Publication Data

US 2003/0037465 A1 Feb. 27, 2003

(30) Foreign Application Priority Data

Aug. 22, 2001 (JP) ..... 2001-252003

(51) Int. Cl.[7] ..... F16D 31/02

(52) U.S. Cl. ..... 60/421; 60/428; 60/429; 60/430; 60/468

(58) Field of Search ..... 60/421, 428, 429, 60/430, 426, 484, 486, 368; 91/388, 403, 448

(56) References Cited

U.S. PATENT DOCUMENTS 5,052,179 A * 10/1991 Fujii ..... 60/421
5,083,428 A * 1/1992 Kubomoto et al. ..... 60/421
5,692,377 A * 12/1997 Moriya et al. ..... 60/421
5,940,997 A * 8/1999 Toyooka et al. ..... 37/411
5,970,709 A * 10/1999 Tohji ..... 60/421
6,148,548 A 11/2000 Tohji

FOREIGN PATENT DOCUMENTS

| | | |
|---|---|---|
| EP | 0 407 231 | 1/1991 |
| EP | 0 715 029 | 6/1996 |
| JP | 61-24730 | 2/1986 |
| JP | 61-142235 | 6/1986 |
| JP | 2-47434 | 2/1990 |
| JP | 5-287775 | 11/1993 |
| JP | 2000-17693 | 1/2000 |
| JP | 2000-282514 | 10/2000 |

* cited by examiner

*Primary Examiner*—Edward K. Look
*Assistant Examiner*—Igor Kershteyn
(74) *Attorney, Agent, or Firm*—Oblon, Spivak, McClelland, Maier & Neustadt, P.C.

(57) ABSTRACT

According to the invention, traveling bypass cut-off valves are disposed in center bypass passages respectively which are located between traveling direction control valves and working direction control valves disposed downstream of the valves, wherein, when at least a traveling motor and any of working actuators are operated simultaneously, the traveling bypass cut-off valves are switched from neutral position to another position. Thereby, when travel and work by working actuators are performed simultaneously, interference between pressure oil fed to traveling motors and pressure oil fed to the working actuators is to be prevented.

19 Claims, 14 Drawing Sheets

HYDRAULIC SYSTEM FOR CONSTRUCTION MACHINE

BACKGROUND OF THE INVENTION

1. Field of the Invention

The present invention relates to a hydraulic system for a construction machine.

2. Description of the Related Art

In a conventional hydraulic circuit of a hydraulic excavator there has been a problem of interference between pressure oil fed to a traveling motor and pressure oil fed to a working actuator in case of performing both travel using the traveling motor and work using the working actuator. In this case, it is difficult to maintain the operation speed of the traveling motor, i.e., the traveling speed of the hydraulic excavator, stably at a desired relatively low speed.

SUMMARY OF THE INVENTION

It is an object of the present invention to provide a hydraulic system for a construction machine capable of preventing the occurrence of interference between pressure oil fed to traveling motors and pressure oil fed to working actuators and smoothly performing a work by operation of the working actuators under travel at a stable speed particularly in case of carrying out both travel and work by the working actuators at a time.

A hydraulic system for a construction machine according to the present invention, comprising: a first traveling motor and a second traveling motor adapted to actuate a pair of travel devices; actuators adapted to actuate working attachments including a boom and an arm; a first hydraulic pump and a second hydraulic pump adapted to supply pressure oil for actuating said first and second traveling motors and said actuators; a first traveling control valve and a second traveling control valve adapted to control amount of pressure oil to be supplied to said first and second traveling motors in accordance with operation of operating means for the first and second traveling motors; working control valves provided correspondingly to said actuators, said working control valves being classified into a first group including said first traveling control valve and a second group including said second traveling control valve, bleed-off passages in all the control valves belonging to said first group being mutually communicated in series as a first center bypass passage toward an oil tank when all the control valves are in their neutral positions, and bleed-off passages in all the control valves belonging to said second group being mutually communicated in series as a second center bypass passage toward an oil tank when all the control valves are in their neutral positions; a straight-travel valve adapted to switch each flowing direction of pressure oil discharged from said first and second hydraulic pumps, said straight-travel valve supplying pressure oil discharged from said first and second hydraulic pumps to said first and second bypass passages respectively when all of said traveling motors and said actuators are not in operation, while in a simultaneous operation mode in which the traveling motor and the actuator associated with the traveling control valve and the working control valve belonging to one of said first and second groups are operated simultaneously, supplying pressure oil discharged from one of said first and second hydraulic pumps to both said first and second traveling control valves and further supplying pressure oil discharged from the other hydraulic pump to the working control valve; and a cut-off valve and an opening valve provided on a downstream side of each of the bleed-off passages in said traveling control valves, said cut-off valve cutting off the center bypass passage located between the traveling control valve and the working control valve associated with the traveling motor and the actuator which are in operation in said simultaneous operation mode of the traveling motor and the actuator being operated simultaneously, said opening valve causing a downstream side of the bleed-off valve in said traveling control valve to be opened to the oil tank.

In this case, the hydraulic system is capable of preventing the occurrence of interference between pressure oil fed to traveling motors and pressure oil fed to working actuators and smoothly performing a work by operation of the working actuators under traveling at a stable speed particularly while carrying out both traveling and work by the working actuators at a time.

DESCRIPTION OF THE PREFERRED EMBODIMENTS

Figure 1:
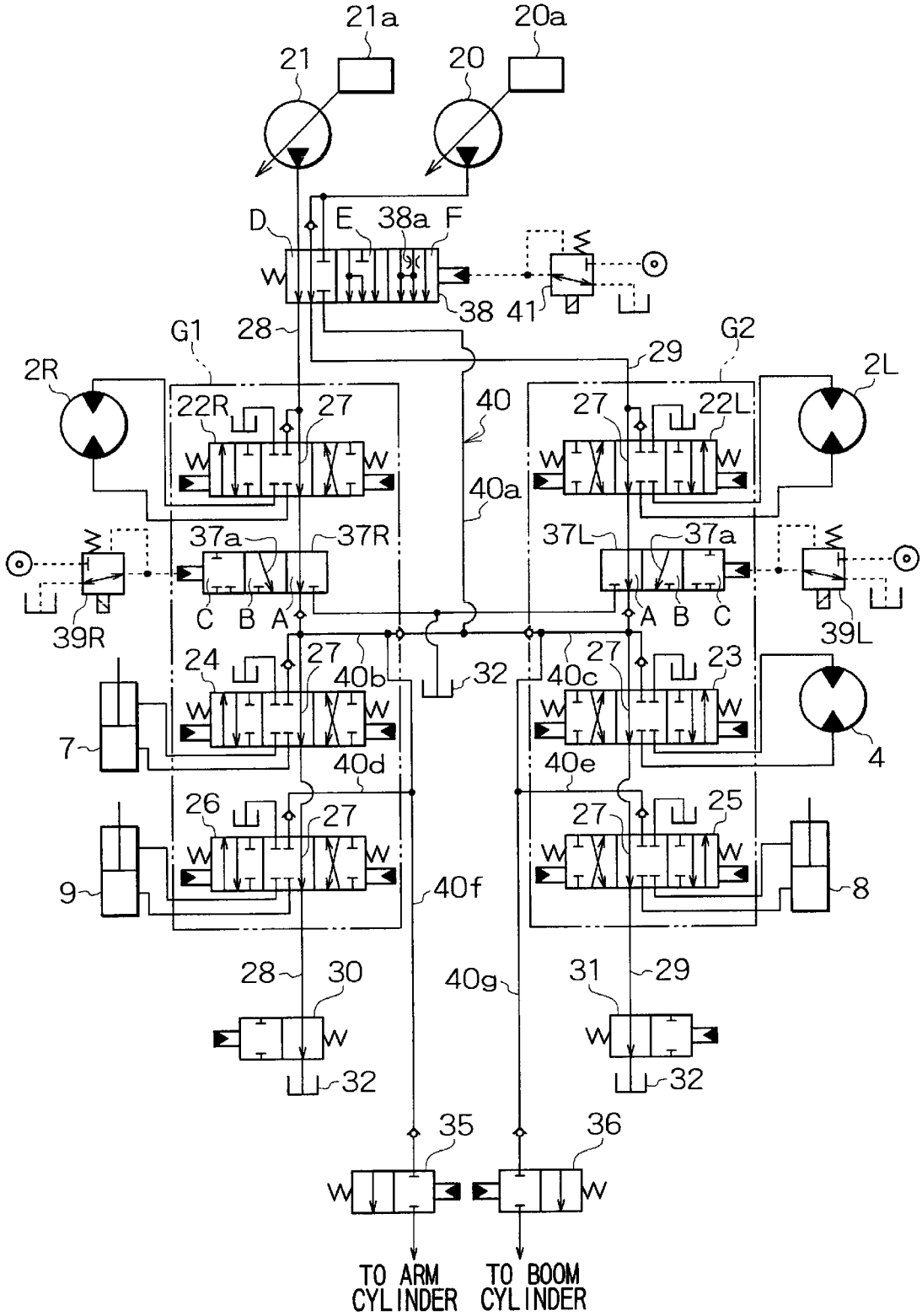
FIG. 1 is a circuit configuration diagram of a hydraulic system according to a first embodiment of the present invention.

A hydraulic system for a construction machine according to the present invention, as a basic construction thereof, comprises a first traveling motor and a second traveling motor for actuating a pair of right and left travel devices respectively in the construction machine; a plurality of working actuators; a first pump and a second pump for supply of pressure oil to actuate the traveling motors and the working actuators; a first traveling control valve and a second traveling control valve provided correspondingly to the traveling motors respectively to control the supply of pressure oil to the traveling motors in accordance with operations of operating levers which are associated with the traveling motors respectively; a plurality of working control valves provided correspondingly to the working actuators respectively to control the supply of pressure oil to the working actuators in accordance with operations of operating levers which are associated with the working actuators respectively, the working control valves being classified into a first group including the first traveling control valve and a second group including the second traveling control valve, a first center bypass passage in which the first traveling control valve and the working control valves included in the first group are disposed successively from an upstream side so that bleed-off passages in the control valves included in the first group are mutually communicated in series toward an oil tank when all the control valves included in the first group are in their neutral positions; and a second center bypass passage in which the second traveling control valve and the working control valves included in the second group are disposed successively from an upstream side so that bleed-off passages in the control valves in the second group are mutually communicated in series toward an oil tank when all the control valves included in the second group are in their neutral positions.

The hydraulic system for a construction machine according to the present invention further comprises a straight-travel valve which switches each flow of pressure oil discharged from the first and second pumps so as to supply the pressure oil to the first and second center bypass passages respectively at least when all of the traveling motors and the working actuators are not in operation and to supply pressure oil discharged from one of both pumps to both traveling control valves and further supply pressure oil discharged from the other pump to the working control valves at least in a simultaneous travel/work mode in which the traveling motor and the working actuator corresponding respectively to the traveling control valve and the working control valve belonging to one and same group out of both said groups are operated simultaneously.

The present invention provides at least two preferable modes for achieving the foregoing object. In the first mode, the hydraulic system according to the present invention further comprises a cut-off valve for cutting off the center bypass passage between the traveling control valve and the working control valve belonging to the above same group and corresponding respectively to the traveling motor and the working actuator which are in operation, and an opening valve for opening a downstream side of the bleed-off passage in the traveling control valve to the oil tank, at least in the simultaneous travel/work mode, on a downstream side of the bleed-off passage in each of the traveling control valves.

According to the first mode of the present invention, at least in the simultaneous travel/work mode, the center bypass passage between the bleed-off passage in the traveling control valve corresponding to the traveling motor in operation and the working control valve corresponding to the working actuator in operation on a downstream side of the traveling control valve, is cut off by the cut-off valve. Consequently, in the simultaneous travel/work mode, pressure oil fed from the one pump through the straight-travel valve to the traveling motor in operation and pressure oil fed from the other pump through the straight-travel valve to the working actuator in operation, do not interfere with each other through the center bypass passage in which are disposed the traveling control valve and the working control valve corresponding to those traveling motor and working actuator. At this time, the bleed-off passage in the traveling control valve corresponding to the traveling motor which is in operation opens to the oil tank through the opening valve, so that bleed-off for the traveling motor is effected appropriately making the most of a characteristic of an opening area of the bleed-off passage in the traveling direction control valve, which characteristic is usually a characteristic of the said opening area becoming smaller with an increase in the amount of operation of the operating lever associated with the traveling direction control valve.

Thus, according to the first mode of the present invention, when both travel and work by the working actuators are performed simultaneously, it is possible to prevent interference between pressure oil fed to the traveling motors and pressure oil fed to the working actuators and thereby perform stably the work by operation of the working actuators while allowing the construction machine to travel at a stable speed.

It is not always necessary for the opening valve to be fully open in its state of opening. For example, the area of its opening may be changed in accordance with the amount of operation of the operating lever corresponding to the traveling motor which is in operation (for example, the opening area may be made smaller with an increase in the amount of operation of the lever). The opening valve may be provided for each traveling control valve or may be provided as a common opening valve (a single opening valve) for both traveling control valves.

According to the first mode of the present invention, in the simultaneous travel/work mode of only one of both traveling motors being operated, it is preferable to control the cut-off valve so that the center bypass passage corresponding to the other traveling motor is cut off by the cut-off valve. That is, in the simultaneous travel/work mode of only one of both traveling motors being operated, pressure oil is fed from the one pump to both traveling control valves through the straight-travel valve. At this time, the traveling control valve corresponding to the other traveling motor (the traveling motor which is not in operation) is in its neutral position and its bleed-off passage is fully open, but the center bypass passage located downstream of the said traveling control valve is cut off. Consequently, the pressure oil from the one pump is prevented from flowing to the traveling control valve corresponding to the other traveling motor and it becomes possible to supply a sufficient amount of pressure oil to the one traveling motor through the traveling control valve corresponding to the one traveling motor which is in operation. In the case where such a cut-off valve as in the foregoing conventional hydraulic system is provided for example on the most downstream side of each center bypass passage, the cut-off valve in the center bypass passage located on the traveling control valve side corresponding to the other traveling motor may be closed, but by allowing the cut-off valve to operate as above it is possible to omit such a conventional cut-off valve.

In the first mode of the present invention the cut-off valve and the opening valve may be constituted by separate valves, of course, but both may be constituted by an integrally constructed control valve as unit, whereby it is possible to reduce the number of components of the hydraulic system.

Further, in the first mode of the present invention, although the cut-off valve and the opening valve may be operated in the above manner only in the foregoing simultaneous travel/work mode, there preferably is provided means which, when all the working actuators are not in operation and when the first or the second traveling motor is in operation, controls the cut-off valve so as to cut off the center bypass passage between the bleed-off passage in the traveling control valve corresponding to the traveling motor which is in operation and the working control valve located on a downstream side thereof, and controls the opening valve so as to open the downstream side of the bleed-off passage in the said traveling control valve to the oil tank.

According to this construction, when the first or the second traveling motor is in operation (including the case where both traveling motors operate), even if the working actuators are not in operation, the cut-off valve and the opening valve operate in the manner described above, so there is no fear that the cut-off valve and the opening valve may operate immediately upon start-up of operation of the working actuators. Thus, there is no fear of a change in the pressure of pressure oil which is fed to the traveling motor in operation transitionally at the time of operation of the cut-off valve and the opening valve. Consequently, it is possible to keep stable the operating speed of the traveling motor which is in operation and hence possible to carry out the work by the working actuators while maintaining the traveling speed of the construction machine stable.

On the other hand, in the second mode of the hydraulic system for a construction machine according to the present invention, each of the traveling control valves is a control valve constructed such that in a neutral position thereof the bleed-off passage thereof opens fully, while in a non-neutral position thereof the said bleed-off passage closes fully, and there are provided an opening valve which, at least when the first or the second traveling motor is in operation, causes an oil passage to open to the oil tank, the said oil passage being located between the traveling control valve associated with the traveling motor which is in operation and the pump for the supply of oil pressure to the said traveling control valve, and means for controlling the area of opening of the opening valve so as to become smaller with an increase in the amount of operation of an operating lever associated with the traveling motor which is in operation.

According to this second mode of the present invention, when the first or the second traveling motor is in operation, the bleed-off passage in the traveling control valve corresponding to the traveling motor which is in operation is kept fully closed, so that the center bypass passage corresponding to the said traveling control valve is cut off by the same traveling control valve.

Therefore, as in the previous first mode, in the simultaneous travel/work mode, pressure oil fed from the one pump through the straight-travel valve to the traveling motor which is in operation and pressure oil fed from the other pump through the straight-travel valve to the working actuator which is in operation, do not interfere with each other through the center bypass passage in which the traveling control valve and working control valve associated with those traveling motor and working actuator are disposed. At this time, of the pressure oil discharged from the one pump, surplus oil exclusive of the pressure oil fed to the traveling motor which is in operation flows to the oil tank through the opening valve, but the area of opening of the opening valve becomes smaller with an increase in the amount of operation of the operating lever associated with the traveling motor which is in operation. Consequently, bleed-off for the traveling motor is effected appropriately through the opening valve.

Thus, according to the second mode of the present invention, as in the first mode, when both travel and work by the working actuators are done simultaneously, it is possible to prevent interference between the pressure oil fed to the associated traveling motor and working actuator respectively and carry out the work by operation of the working actuator smoothly while allowing the construction machine to travel at a stable speed.

In the second mode of the present invention, when only one of both traveling motors is operated and when such a cut-off valve as in the foregoing conventional hydraulic system is provided for example on the most downstream side of each center bypass passage, the cut-off valve in the center bypass passage having a traveling control valve corresponding to a traveling motor which is not in operation may be closed. Alternatively, there may be adapted a construction wherein a valve capable of being opened and closed is disposed in each center bypass passage on the downstream side of each traveling control valve and is allowed to operated in the same manner as the aforesaid cut-off valve.

Preferably, in the above first and second modes of the present invention, the straight-travel valve is a control valve having a first operating position for providing pressure oils from the first and second pumps independently and respectively to the first and second traveling control valves, a second operating position for providing pressure oil from one of both pumps to only both traveling control valves and providing pressure oil from the other pump to only the plural working control valves, and a third operating position for providing communication through a throttle valve between an oil passage communicating with both traveling control valves in the second operating position and an oil passage communicating with the working control valves in the second operating position, and there is provided means which, at least in the simultaneous travel/work mode, controls the straight-travel valve to the second operating position when the amount of operation of an operating lever associated with the traveling motor which is in operation is not larger than a predetermined amount, while when the amount of operation of the operating lever exceeds the predetermined amount, makes control to switch the position of the straight-travel valve to the third operating position from the second operating position.

According to this construction, in the simultaneous travel/work mode, the straight-travel valve is controlled to the second operating position when the amount of operation of the operating lever associated with the traveling motor which is in operation is not larger than the predetermined amount, that is, when the said amount of operation is relatively small, so that the pressure oils from one and the other pumps are fed each independently to the traveling motor and the working actuator which are in operation. Thus, coupled with the foregoing cut-off condition of the associated center bypass passage, the pressure oils from both pumps are sure to be prevented from interference. Consequently, the work by operation of working actuators can be done smoothly while allowing the construction machine to travel stably at a relatively low speed. Besides, since the position of the straight-travel valve is switched to the third operating position when the amount of operation of the operating lever associated with the traveling motor which is in operation exceeds the predetermined amount, pressure oil can be fed to both traveling control valves not only from the one pump but also from the other pump by virtue of the foregoing throttle effect. As a result, it becomes possible to let the traveling motors operate at a sufficiently high speed.

Preferably, in the first and second modes of the present invention provided with the straight-travel valve, there is provided means which, when the first or the second traveling motor is in operation with all of the working actuators stopped, controls the position of the straight-travel valve to the second operating position when the amount of operation of the operating lever associated with the traveling motor which is in operation is not larger than the foregoing predetermined amount, while when the amount of operation of the operating lever exceeds the predetermined amount, makes control to switch the position of the straight-travel valve from the second to the first operating position.

According to this construction, when the construction machine is traveling with the working actuators stopped and in a state in which the amount of operation of the operating lever associated with the traveling motor which is in operation is not larger than the predetermined amount and is relatively small, the position of the straight-travel valve is controlled to the second operating position. Therefore, even if the working actuators are started to operate in this state, the straight-travel valve is held in the second operating position. Thus, even if the working actuators are started to operate during travel at a relatively low speed, there is no fear that the flow of pressure oil may suddenly change transitionally. As a result, the operating speed of the traveling motor can be kept stable. Moreover, if the amount of operation of the operating lever associated with the traveling motor which is in operation becomes relatively large with the working actuators stopped, the position of the straight-travel valve is switched to the first operating position, thus permitting the supply of pressure oils from both pumps independently to the traveling control valves. Consequently, each traveling motor can be operated at a sufficiently high speed. If the operation of the working actuators is started in this state, the position of the straight-travel valve is switched to the third operating position, so there is no fear of a sudden decrease in the amount of pressure oil fed to the traveling motor which is in operation, whereby a sudden decrease in the traveling speed of the construction machine is prevented.

Preferably, there is provided means which holds the straight-travel valve in the second operating position by a predetermined operation at least in the simultaneous travel/work mode.

According to this construction, when the driver of the construction machine performs a predetermined operation (e.g., operates a switch or performs a voice input operation), the straight-travel valve is held in the second operating position even if the amount of operation of the operating lever associated with the traveling motor in operation becomes large in excess of the predetermined amount. Thus, for holding the straight-travel valve in the second operating position and for avoiding mutual interference of pressure oil fed to the traveling motor in operation and the working actuators, the amount of operation of the operating lever associated with the traveling motor in operation need not be maintained at a value of not larger than the predetermined amount. That is, by a relatively rough operation of the operating lever, the operating position of the straight-travel valve can be held in the second operating position which permits positive avoidance of the aforesaid interference. As a result, the work by working actuators can be done while the construction machine is allowed to travel easily at a stable speed by operation of the traveling motor.

In this case, there preferably are provided means which, at least in the simultaneous travel/work mode, adjusts the discharge rate of the pump for the supply of pressure oil to the traveling motor in operation in accordance with the amount of operation of the operating lever associated with the traveling motor, and means which sets, for the means of adjusting the discharge rate of the pump, a characteristic of a change in the discharge rate based on a change in the amount of operation of the operating lever variably by a predetermined operation.

According to this construction, in the simultaneous travel/work mode, the discharge rate in the pump for the supply of pressure oil to the traveling motor in operation, which discharge rate is proportional to the amount of operation of the operating lever associated with the traveling motor, can be adjusted to a flow rate which the driver desires. Consequently, for example, the operating speed of the traveling motor can be limited to a low speed by keeping the discharge rate low. Thus, the work by operation of the working actuators can be done while maintaining the traveling speed of the construction machine by the traveling motor at a low speed stably and easily.

Alternatively, in the first mode of the present invention there may be provided means which, at least in the simultaneous travel/work mode, adjusts the area of opening of the opening valve in accordance with the amount of operation of the operating lever associated with the traveling motor in operation, and means which sets, for the means of adjusting the opening area of the opening valve, a characteristic of a change in the opening area in accordance with a change in the amount of operation of the said operating lever variably by a predetermined operation. In the second mode of the present invention there may be provided means which, at least in the simultaneous travel/work mode, sets a characteristic of a change in the opening area in accordance with a change in the amount of operation of the operating lever variably by a predetermined operation for the means of controlling the opening area of the opening valve.

According to this construction, in the simultaneous travel/work mode, the flow rate of bleed-off for the traveling motor in operation and proportional to the amount of operation of the operating lever associated with the traveling motor can be adjusted to a flow rate which the driver desires. Therefore, for example it becomes possible to adjust the flow rate of bleed-off to a rather large flow rate and thereby limit the operating speed of the traveling motor to a low speed. Thus, the work by the working actuators can be done while keeping the traveling speed of the construction machine by the traveling motor at a low speed stably and easily.

Preferably, according to the first and second modes of the present invention, in the simultaneous travel/work mode, the oil passage for the supply of pressure oil discharged from the other pump to the working control valves through the straight-travel valve is communicated with an inlet side of the bleed-off passage in each working control valve located on an upstream side of in each of the first and second groups and is also communicated with an inlet side of a meter-in passage in each of the working control valves in the first and second groups.

According to this construction, in the simultaneous travel/work mode, surplus pressure oil discharged from the other pump as a source of pressure oil supply for the working actuators flows from the straight-travel valve through the oil passage to an inlet side of the bleed-off passage in the working control valve located on the upstream side and flows through the center bypass passage connected to the downstream side of the working control valve. Thus, the operation of each working actuator can be done smoothly while making the most of the opening area characteristic of the bleed-off passage in each working control valve.

Concretely, the present invention will be described hereinunder by way of embodiments thereof illustrated in the drawings. It is to be understood that the invention is not limited to those embodiments.

A first embodiment of the present invention will be described below with reference to FIGS. 1 to 7. This embodiment is related to the hydraulic system in a hydraulic excavator. Further, this embodiment is related to the foregoing first mode of the present invention.

Referring to FIG. 1, the hydraulic system of this embodiment is also provided with two variable displacement pumps 20 and 21, direction control valves (traveling control valves) 22R and 22L which are for controlling the supply of pressure oil to right and left traveling motors 2R, 2L in a hydraulic excavator, a direction control valve 23 for controlling the supply of pressure oil to a rotating motor 4, direction control valves 24, 25, and 26 for controlling the supply of pressure oil to a boom cylinder 7, an arm cylinder 8, and a bucket cylinder 9, a center bypass passage 28 in which the direction control valves 22R, 24, and 26 belonging to a first group are disposed successively from an upstream side, and a center bypass passage 29 in which the direction control valves 22L, 23, and 25 belonging to a second group are disposed successively from the upstream side. The direction control valves 23 to 26 correspond to the working control valves in the present invention. In the following description, the rotating motor 4, boom cylinder 7, arm cylinder 8, and bucket cylinder 9 will sometimes be referred to as working actuators 4 and 7~9 generically.

Cut-off valves 30 and 31 capable of being opened and closed are disposed downstream of the direction control valves 26 and 25 which are located at most downstream positions in the center bypass passages 28 and 29 respectively. In the same figure, the numeral 35 denotes an arm confluence valve for making pressure oil from both pumps 20 and 21 join together and feeding the joined flow to the arm cylinder 8 where required for actuating an arm in the hydraulic excavator, numeral 36 denotes a boom confluence valve for making pressure oil from both pumps 20 and 21 join together and feeding the joined flow to the boom cylinder 7 where required for actuating a boom, and numerals 20*a* and 21*a* denote regulators for adjusting the discharge rates of the pumps 20 and 21 respectively.

On the other hand, as the opening valve and cut-off valve referred to in the first mode of the present invention, the hydraulic system of this embodiment is provided with a pair of traveling bypass cut-off valves 37R and 37L possessing the functions of both cut-off valve and opening valve, as well as a straight-travel valve 38.

The traveling bypass cut-off valves 37R and 37L are each a three-position change over valve (spool valve) of the same structure having a neutral position A, a position B, and a position C. The traveling bypass cut-off valve 37R is disposed in the center bypass passage 28 at a position between the direction control valve 22R for right-hand travel and the direction control valve 24 for boom located downstream of the valve 22R, while the traveling bypass cut-off valve 37L is disposed in the center bypass passage 29 at a position between the direction control valve 22L for left-hand travel and the direction control valve 23 for rotation located downstream of the valve 22L.

When the traveling bypass cut-off valve 37R, which is located on group G1 side, is in its neutral position A, it causes a bleed-off port of a bleed-off passage 27 in the direction control valve 22R for right-hand travel to communicate with an inlet port of a bleed-off passage 27 in the direction control valve 24 for boom located downstream of the valve 22R. When the traveling bypass cut-off valve 37R is in its position B, it causes the outlet port of the bleed-off passage 27 in the direction control valve 22R for right-hand travel to open to an oil tank 32 through an oil passage 37a formed in the interior of the bypass cut-off valve 37R and at the same time cuts off the flow of pressure oil from the bleed-off passage 27 in the right-hand traveling direction control valve 22R located on the upstream side to the bleed-off passage 27 in the direction control valve 24 for boom located on the downstream side (cuts off the center bypass passage 28 between the direction control valves 22R and 24). Further, when the traveling bypass cut-off valve 37R is in its position C, it cuts off the flow of pressure oil from the bleed-off passage 27 in the right-hand traveling direction control valve 22R to the bleed-off passage 27 in the direction control valve 24 for boom located on the downstream side and to the oil tank 32 (closes the center bypass passage 28 extending from the valve 22R to the valve 37R). The oil passage 37*a* which comes into communication with the oil tank 32 at position B of the traveling bypass cut-off valve 37R becomes gradually smaller in the area of its opening as the bypass cut-off valve 37R switches gradually to position C from position B.

Like the traveling bypass cut-off valve 37R, when the traveling bypass cut-off valve 37L, which is located on second group G2 side, is in its neutral position A, it causes an output port of a bleed-off passage 27 in the direction control valve 22L for left-hand travel to communicate with an inlet port of a bleed-off passage in the direction control valve 23 for rotation located downstream of the valve 22L. When the traveling bypass cut-off valve 37L is in its position B, it causes the output port of the bleed-off passage 27 in the direction control valve 22L for left-hand travel to open to the oil tank 32 through an oil passage 37*a* formed in the interior of the bypass cut-off valve 37L and at the same time cuts off the flow of pressure oil from the bleed-off passage 27 in the left-hand traveling direction control valve 22L located on the upstream side to the bleed-off passage 27 in the direction control valve 23 for rotation located on the downstream side. Further, at position C of the traveling bypass cut-off valve 37L, the traveling bypass cut-off valve 37L cuts off the flow of pressure oil from the bleed-off passage 27 in the right-hand traveling direction control valve 22L to the bleed-off passage 27 in the direction control valve 23 for rotation located on the downstream side and to the oil tank 32.

Electromagnetic proportional reducing valves 39R and 39L are connected respectively to pilot ports of the traveling bypass cut-off valves 37R and 37L. The reducing valves 39R and 39L, when respective solenoids are energized, produce a pilot pressure of a level proportional to the energizing current from pressure oil of a constant pressure level discharged from a pilot pump (not shown) and provide it to the pilot ports of the traveling bypass cut-off valves 37R and 37L. The pilot pressure thus produced becomes larger as the energizing current increases. In the following description the electromagnetic proportional reducing valves 39R and 39L will be referred to as the right-hand traveling proportional valve 39R and the left-hand traveling proportional valve 39L, respectively.

The straight-travel valve 38 is a three-position control valve (spool valve) having a neutral position D (first operating position), a position E (second operating position), and a position F (third operating position). Upstream ends of both center bypass passages 28 and 29 and an upstream end of a working oil passage 40 are connected respectively to three outlet ports of the straight-travel valve 38, the working oil passage 40 being for the supply of pressure oil to the direction control valves 23~26 associated with the working actuators 4 and 7~9 without going through both traveling direction control valves 22R and 22L. Further, a discharge port of the pump 21 is connected in communication with one of three inlet ports of the straight-travel valve 38 and a discharge port of the pump 20 is connected in communication with the remaining two inlet ports of the straight-travel valve 38.

In this case, the straight-travel valve 38, in its neutral position D, causes the discharge port of the pump 21 to open to only the center bypass passage 28, causes the discharge port of the pump 20 to open to only the center bypass passage 29, and closes the upstream end of the working oil passage 40. When the straight-travel valve 38 is in its position E, it causes the discharge port of the pump 21 to open to both center bypass passages 28 and 29 and causes the discharge port of the pump 20 to open to only the working oil passage 40. Further, at the position F of the straight-travel valve 38, the discharge port of the pump 20 is opened to both center bypass passages 28 and 29 through a throttle passage 38*a* formed in the interior of the straight-travel valve 38, in addition to opening the discharge port of the pump 21 to both center bypass passages 28 and 29 and opening the discharge port of he pump 20 to the working oil passage 40.

To a pilot port of the straight-travel valve 38 is connected an electromagnetic proportional reducing valve 41 (hereinafter referred to as the "straight-travel proportional valve 41) of the same construction as the right- and left-hand traveling proportional valves 39R, 39L.

The working oil passage 40 is provided with a main passage 40*a* connected to the straight-travel valve 38 and plural branch passages 40*b*~40*g* branched from the main passage 40*a*. Of the branch passages 40*b*~40*g*, the branch passage 40*b* is connected to the center bypass passage 28 located between the traveling bypass cut-off valve 37R and the direction control valve 24 for boom on the first group G1 side and is also connected to an inlet port of a meter-in passage in the direction change-valve 24 for boom. Likewise, the branch passage 40*c* is connected to the center bypass passage 29 located between the traveling bypass cut-off valve 37L and the direction control valve 23 for rotation on the second group G2 side and is also connected to an inlet port of a meter-in passage in the direction control valve 23. The branch passages 40*d* and 40*e* are connected respectively to an inlet port of a meter-in passage in the direction control valve 26 for bucket and an inlet port of a meter-in passage in the direction control valve 25 for arm. Further, the branch passages 40*f* and 40*g* are connected respectively to an inlet port of the arm confluence valve 35 and an inlet port of the boom confluence valve 36.

Figure 2:
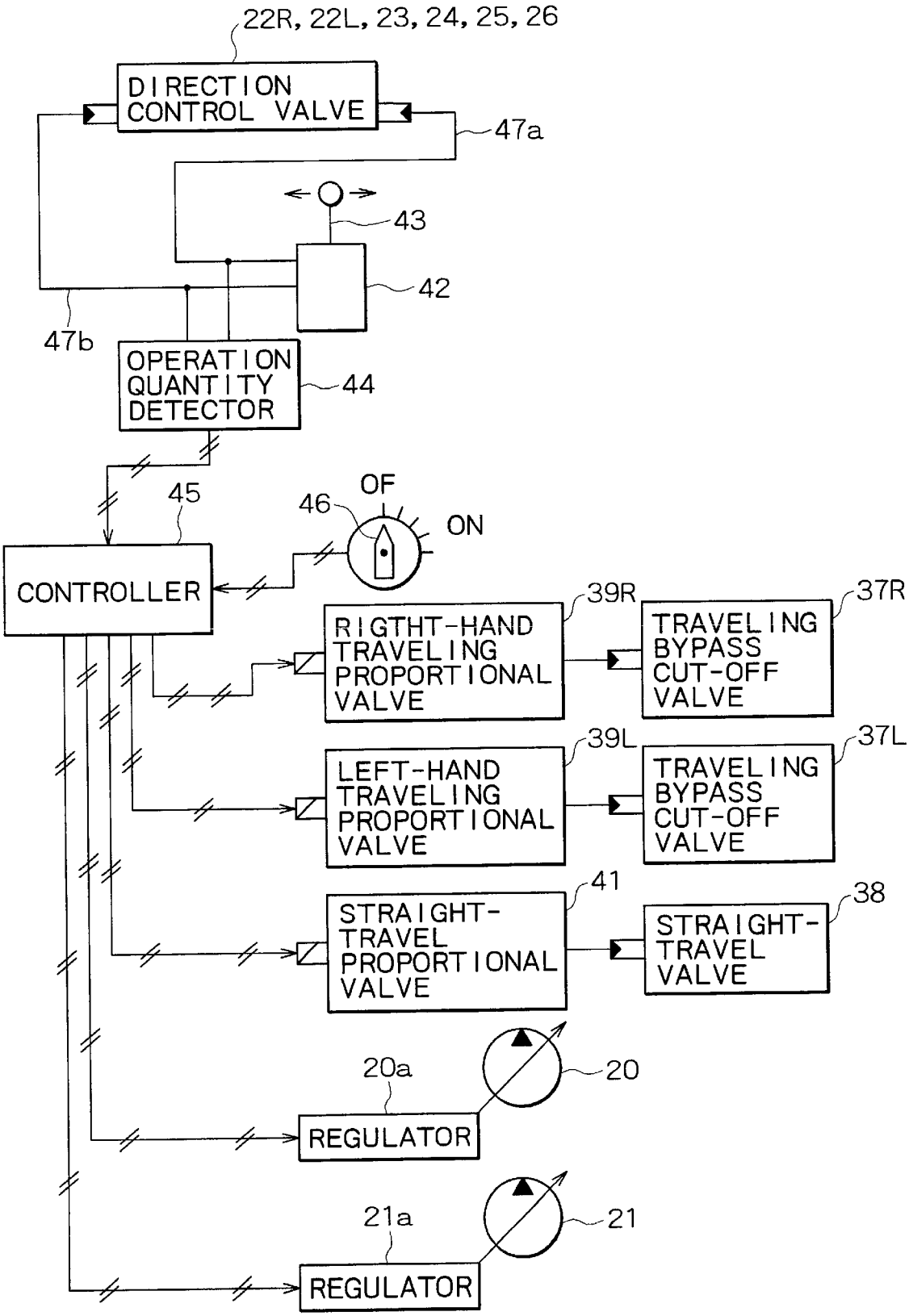
FIG. 2 is a block diagram showing the construction of a control system used in the hydraulic system of FIG. 1.

Referring now to FIG. 2, in this embodiment, for controlling the operation of the hydraulic system described above there are provided an operation quantity detector 44 for detecting operation quantities of operation levers 43 which operate the direction control valves 22R, 22L, and 23~26 respectively through a pilot operation unit 42, a controller 45 which controls the switching operations of the traveling bypass cut-off valves 37R, 37L and the straight-travel valve 38 through the right- and left-hand traveling proportional valves 39R, 39L, and the straight-travel proportional valve 41 and which controls the discharge rates of the pumps 20 and 21 through regulators 20*a* and 21*a*, and an operating volume 46 with which the driver of the hydraulic excavator 1 specifies for the operator of the hydraulic excavator a control characteristic for the straight-travel valve 38 by the controller 45 and a flow characteristic of the pumps 20 and 21. Actually, plural operating levers 43 are provided correspondingly to the direction control valves 22R, 22L, and 23~26, but in FIG. 2 there are shown one direction control valve and one operating lever 43 as representative illustrations for convenience' sake. The controller 45 is constituted by an electronic circuit including a microcomputer, etc. (not shown).

When the operating levers 43 corresponding respectively to the direction control valves 22R, 22L, and 23~26 are operated from their neutral positions, the pilot operation unit 42 produces pilot pressures proportional to the amounts of the operations and outputs the pilot pressures to pilot passages 47*a* or 47*b* matching the operated directions of the operating lever 43 out of paired pilot passages 47*a* and 47*b* connected respectively to paired pilot ports of the direction control valves 22R, 22L, and 23~26. The operation quantity detector 44 detects the pilot pressures in the pilot passages 47*a* or 47*b* as pressures which represent the amounts of operation of the operating levers 43, then outputs the detected signals to the controller 45. The pilot pressures outputted from the pilot operation unit 42 to the pilot passages 47*a* and 47*b* become higher with an increase in the amount of operation of the operating levers 43.

In this embodiment the operating volume 46 is a rotary dial type for example and outputs a signal with a level matching its rotational position to the controller 45. In this case, the position "OFF" in the figure corresponds to a standard operating position of the operating volume 46.

Next, a description will be given of the operation of the hydraulic system in the hydraulic excavator of this embodiment. First, reference will be made to a basic operation of the hydraulic system. In the description of the basic operation it is assumed that the operating volume 46 is in the "OFF" position.

Figure 3:
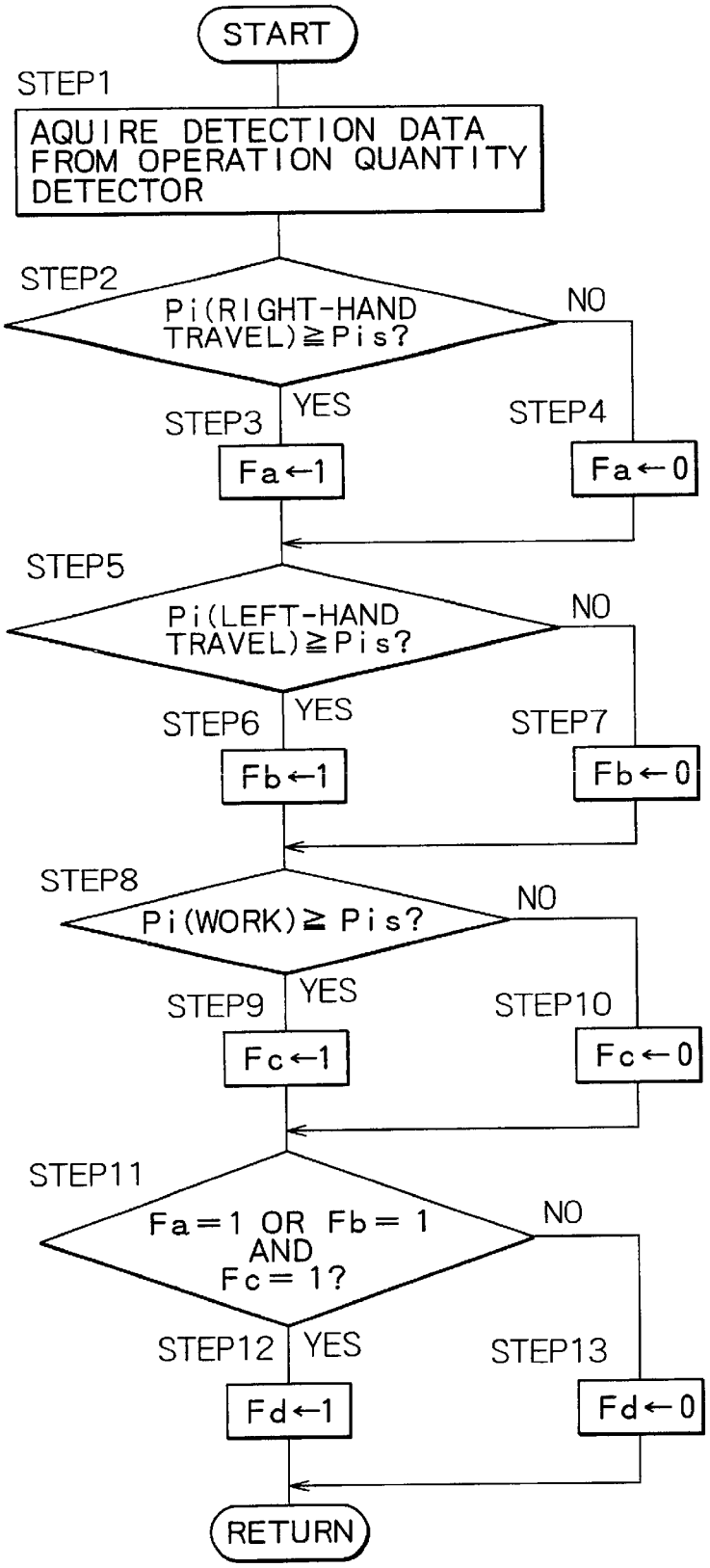
FIG. 3 is a flow chart showing a processing carried out by a controller in the control system of FIG. 2.

The controller 45 executes a processing for judging an operation mode of the hydraulic system with a predetermined cycle time successively in such a manner as shown in a flowchart of FIG. 3.

First, the controller 45 acquires detection data on the operating levers 43 from the operation quantity detector 44, that is, acquires detection data on pilot pressures provided to the direction control valves 22R, 22L, and 23~26, (STEP 1). Then, the controller 45 compares the level of a pilot pressure Pi (right-hand travel) which represents the amount of operation of the operating lever 43 associated with the right-hand traveling motor 2R, with a minimum pressure Pis at which a switching operation starts from the neutral position A of the direction control valve 22R (STEP 2). At this time, if Pi (right-hand travel)≧Pis (with the right-hand traveling motor 2R ON), the controller 45 sets the value of Flag Fa to "1" (STEP 3), while if Pi (right-hand travel)<Pis (with the right-hand traveling motor 2R OFF), the controller sets the value of Flag Fa to "0" (STEP 4).

The controller 45 further compares the level of a pilot pressure Pi (left-hand travel) which represents the amount of operation of the operating lever 43 associated with the left-hand traveling motor 2L, with the minimum pressure Pis (STEP 5), and if Pi (left-hand travel)≧Pis (with the left-hand traveling motor 2L ON), the controller 45 sets the value of Flag Fb to "1" (STEP 6), while if Pi (left-hand travel)<Pis (the left-hand traveling motor 2L OFF), the controller sets the value of Flag Fb to "0" (STEP 7).

Then, the controller 45 compares pilot pressures Pi (work) which represent the amounts of operation of the operating levers 43 associated with the working actuators 4 and 7~9, with the minimum pressure Pis (STEP 8), and if any one of the pilot pressures Pi (work) is Pi (work)≧Pis (when at least one of the working actuators 4 and 7~9 is ON), the controller 45 sets the value of Flag Fc to "1" (STEP 9), while if all the pilot pressures Pi (work) are in a relation of Pi (work)<Pis (when all the working actuators 4 and 7~9 are OFF), the controller 45 sets the value of Flag Fc to "0" (STEP 10).

Then, the controller 45 judges whether the value of Flag Fa or Fb is "1" (including the case of Fa=Fb=1) and whether the value of Fc is "1," that is, whether the operation of the traveling motor 2R or 2L (including simultaneous operation of the two) and the operation of any of the working actuators 4 and 7~9 are being done simultaneously (STEP 11). At this time, if Fa=1 or Fb=1 and Fc=1, the controller 45 sets the value of Flag Fd to "1" (STEP 12), while if Fa=Fb=0 or Fc=0, the controller 45 sets the value of Flag Fd to "0" (STEP 13).

After thus setting the values of Flags Fa to Fd, if Fa=1 or Fb=1, that is, if the traveling motor 2R or 2L is in operation, the controller 45 determines energizing currents for the right- and left-hand traveling proportional valves 39R, 39L associated with the traveling bypass cut-off valves 37R and 37L respectively, in the following manner.

Figure 4A:
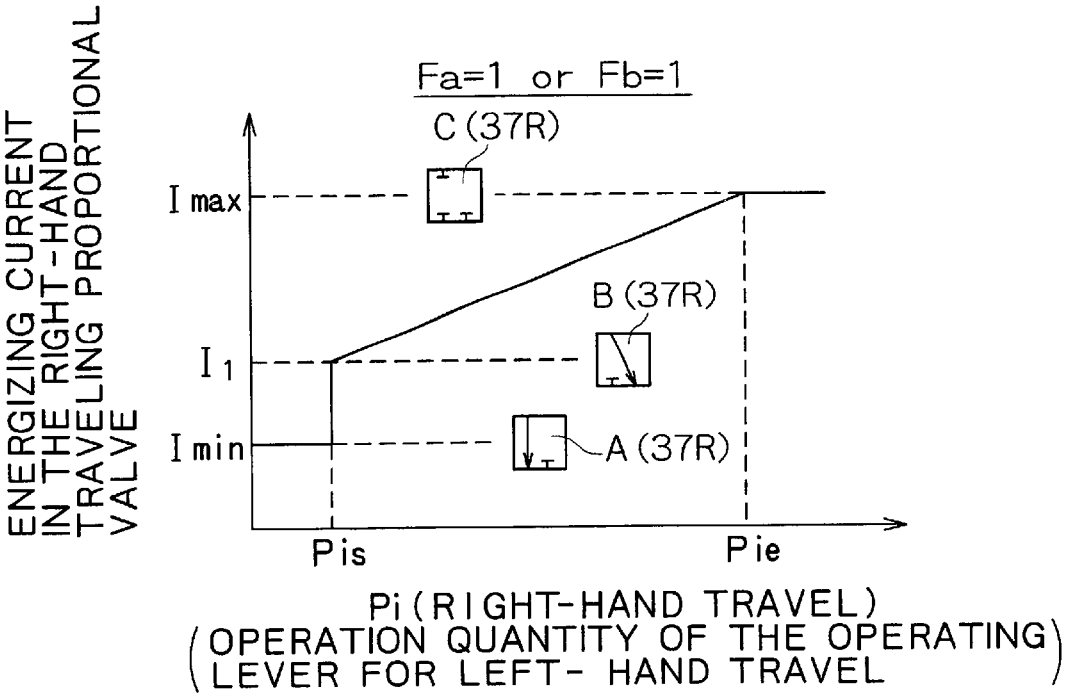
FIGS. 4A, 4B are diagrams for explaining the operation of the hydraulic system of FIG. 1.
Figure 4B:
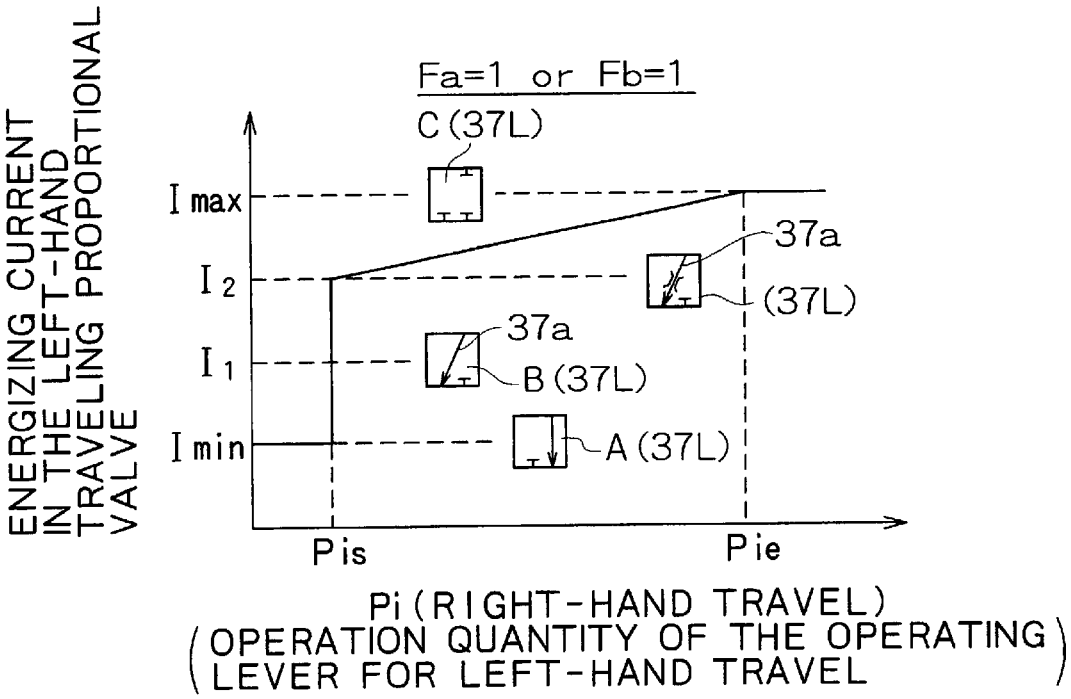

First, with reference to data tables built in advance, as shown in FIGS. 4A and 4B, and in accordance with pilot pressure Pi (right-hand travel) which represents the amount of operation of the operating lever 43 associated with the right-hand traveling motor 2R, the controller 45 sets energizing currents for the right- and left-hand traveling proportional valves 39R, 39L temporarily.

In the data table of FIG. 4A, the energizing current for the right-hand traveling proportional valve 39R becomes a current I1 which switches the position of the traveling bypass cut-off valve 37R from the neutral position held by a predetermined lower-limit current Imin to the position B in an instant when the pilot pressure Pi (right-hand travel) becomes the minimum pressure Pi or higher . As the pilot pressure Pi (right-hand travel) increases (the amount of operation of the operating lever 43 for right-hand travel increases), the energizing current in the right-hand traveling proportional valve 39R increases gradually from the current I1 up to a predetermined upper-limit current Imax which holds the traveling bypass cut-off valve 37R at the position C. Pie in the figure represents a pilot pressure corresponding to a nearly maximum operation quantity of an operating lever 43.

In the data table of FIG. 4B, the energizing current in the left-hand traveling proportional valve 39L increases from the lower-limit current Imin up to a current I2 (>I1) which switches the traveling bypass cut-off valve 37L to an intermediate position between the positions B and C in an instant when the pilot pressure Pi (right-hand travel rises to a level above the minimum pressure Pis. As the pilot pressure Pi (right-hand travel) increases (the amount of operation of the operating lever 43 for right-hand travel increases), the energizing current in the left-hand traveling proportional valve 39L increases gradually from the current I2 up to the upper-limit current Imax. In an intermediate position between the positions B and C of the traveling bypass cut-off valve 37L, as added correspondingly to the current I2 in FIG. 4B, a throttle is formed in the oil passage 37*a* of the traveling bypass cut-off valve 37L and the opening area of the passage becomes smaller as the energizing current increases. This is also the case with the traveling bypass cut-off valve 37R.

Figure 5A:
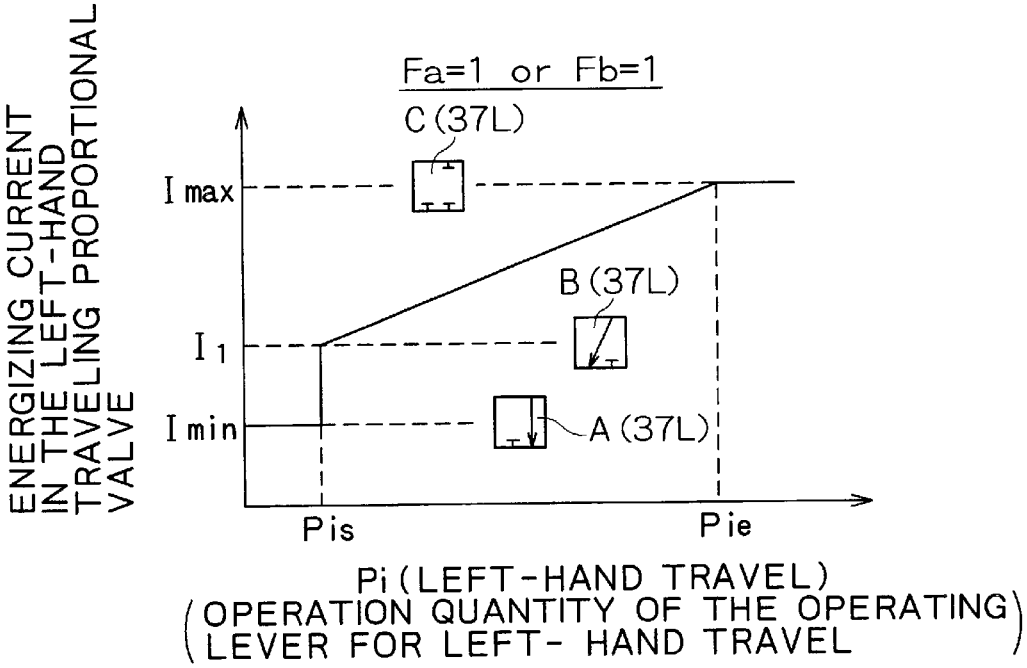
FIGS. 5A, 5B are diagrams for explaining the operation of the hydraulic system of FIG. 1.
Figure 5B:
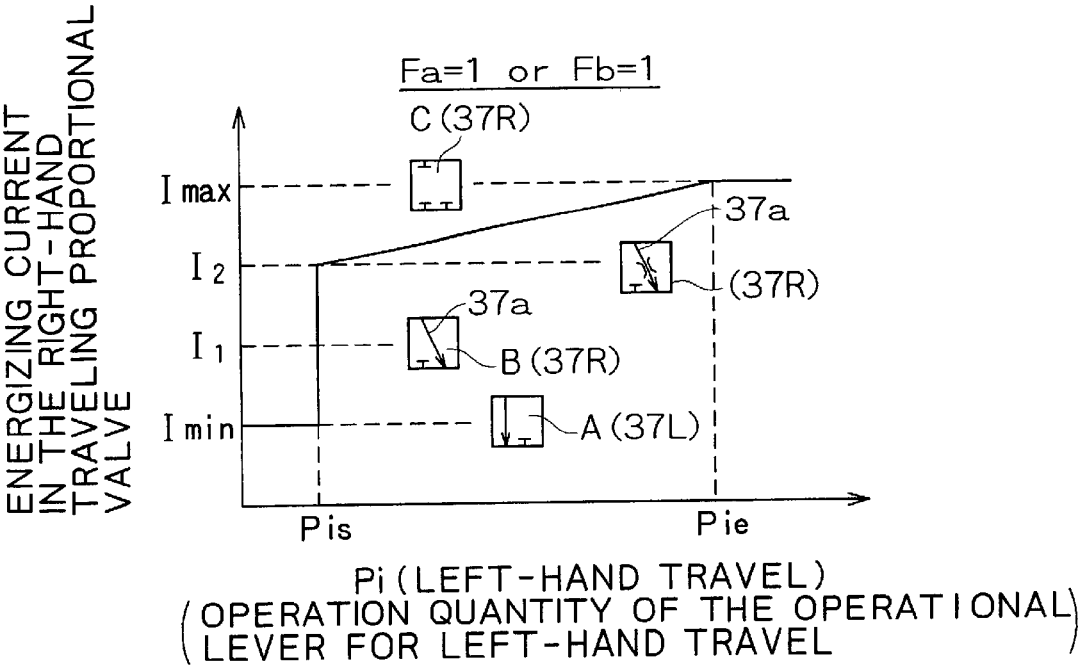

Further, with reference to data tables built in advance, as shown in FIGS. 5A and 5B, and in accordance with pilot pressure Pi (left-hand travel) which represents the amount of operation of the operating lever 43 associated with the left-hand traveling motor 2L, the controller 45 sets energizing currents for the right- and left-traveling proportional valves 39R, 39L temporarily.

In the data table of FIG. 5A, the energizing current in the left-hand traveling proportional valve 39L with respect to the pilot pressure Pi (left-hand travel) possesses the same characteristic as in the data table of FIG. 4A. Likewise, in the data table of FIG. 5B, the energizing current in the right-hand traveling proportional valve 39R with respect to the pilot pressure Pi (left-hand travel) possesses the same characteristic as in the data table of FIG. 4B.

In this way energizing currents for the right- and left-hand traveling proportional valves 39R, 39L are set temporarily in accordance with pilot pressure Pi (right-hand travel) and energizing currents for the left- and right-hand proportional valves 39L, 39R are set temporarily in accordance with pilot pressure Pi (left-hand travel). Thereafter, the controller 45 determines the energizing current of the larger value as the energizing current to be actually fed to the right-hand traveling proportional valve 39R out of the energizing current which has been determined temporarily with reference to the data table of FIG. 4A and in accordance with pilot pressure Pi (right-hand travel) and the energizing current which has been set temporarily with reference to the data table of FIG. 5B and in accordance with pilot pressure Pi (left-hand travel). The controller 45 then supplies the thus-determined energizing current to the right-hand traveling proportional valve 39R. Likewise, as to the left-hand traveling proportional valve 39L, the controller 45 determines the energizing current of the larger value as the energizing current to be actually fed to the left-hand traveling proportional valve 39L out of the energizing current which has been set temporarily with reference to the data table of FIG. 4B and in accordance with pilot pressure Pi (right-hand travel) and the energizing current which has been set temporarily with reference to the data table of FIG. 5A and in accordance with pilot pressure Pi (left-hand travel). Then, the controller 45 supplies the thus-determined energizing current to the left-hand traveling proportional valve 39L.

Further, if Fa=1 or Fb=1 (when the traveling motor 2R or 2L is in operation), the controller 45 determines an energizing current for the straight-travel proportional valve 41 in the following manner.

Figure 6A:
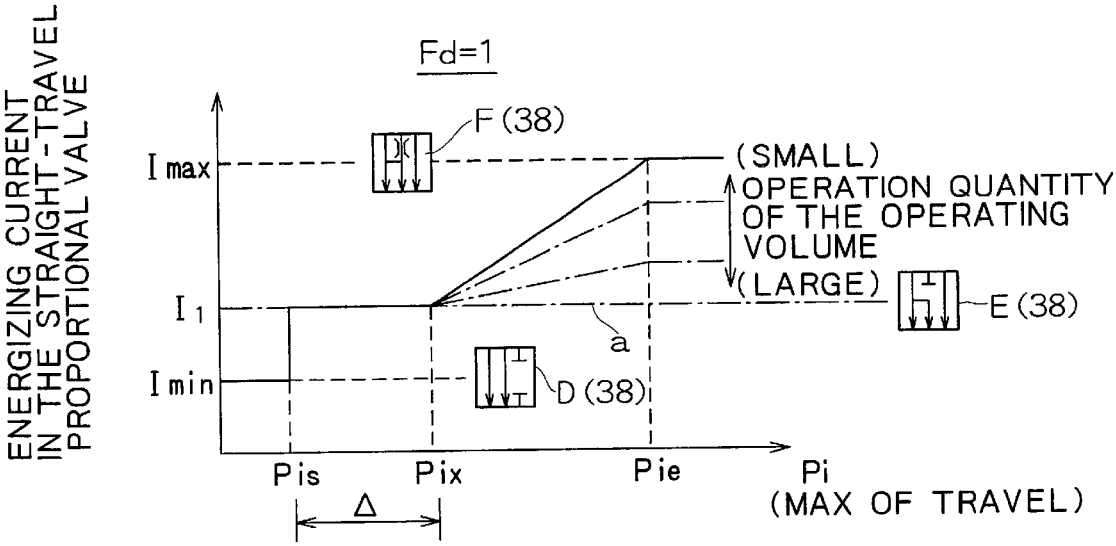
FIGS. 6A, 6B are diagrams for explaining the operation of the hydraulic system of FIG. 1.

More specifically, if the value of Flag Fd is "1" (when the traveling motor 2R or 2L and any of the working actuators 4 and 7~9 are simultaneously in operation), the controller 45 determines an energizing current for the straight-travel proportional valve 41 with reference to a table built in advance, as indicated with a solid line in FIG. 6A, and in accordance with the larger pilot pressure Pi (travel max or max of travel)=max (Pi (right-hand travel), Pi (left-hand travel) out of pilot pressures Pi (right-hand travel) and pilot pressure Pi (left-hand travel). Then, the controller 45 supplies the thus-determined energizing current to the straight-travel proportional valve 41.

In the solid-line data table of FIG. 6A, when the pilot pressure Pi (travel max) becomes the minimum pressure Pis or higher, the energizing current in the straight-travel proportional valve 41 becomes such a current I1 as switches the straight-travel valve 38 to position E in an instant and holds it in that position. In a state in which the pilot pressure Pi (travel max) is not higher than a predetermined value Pix (Pis<Pix<Pie), that is, in a state in which the pilot pressure Pi (travel max) lies in a range Δ where it is relatively small (when the amount of operation of the operating lever 43 for left-hand travel and that of the operating lever 43 for right-hand travel are both relatively small), the energizing current in the straight-travel proportional valve 41 is maintained in the above current I1 to hold the straight-travel valve 38 in position E. Further, when the pilot pressure Pi (travel max) exceeds the range Δ ("low-operation range Δ" hereinafter) and becomes the predetermined value Pix or higher, the energizing current in the straight-travel proportional valve 41 increases gradually from the current I1 up to such a predetermined upper-limit current Imax as holds the straight-travel valve 38 in the position F as the pilot pressure Pi (travel max) increases (as the amount of operation of at least one of the right- and left-hand traveling operating levers 43, 43 increases). When the energizing current in the straight-travel proportional valve 41 is of a magnitude between the current I1 and the upper-limit current Imax, the straight-travel valve 38 assumes a state intermediate between the positions E and F. As to the dot-dash line graph in FIG. 6A, reference will be made later.

Figure 6B:
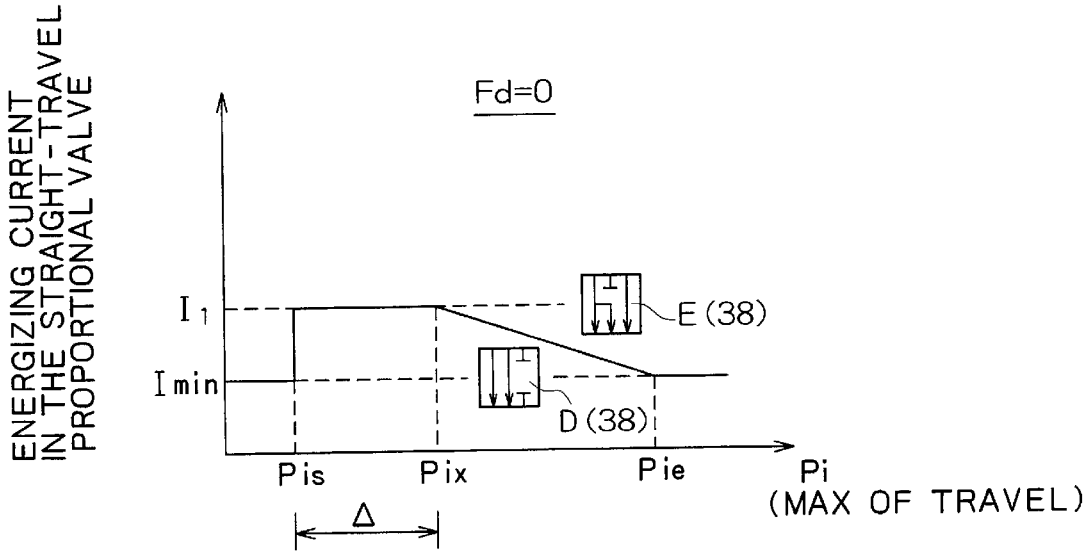

When the value of Flag Fd is "0" (when either the traveling motor 2R or 2L is in operation and all of the working actuators 4 and 7~9 are OFF), the controller 45 determines an energizing current for the straight-travel proportional valve 41 with reference to a predetermined data table, as shown in FIG. 6B, and in accordance with pilot pressure Pi (travel max). Then, the controller 45 supplies the thus-determined energizing current to the straight-travel proportional valve 41.

In the data table of FIG. 6B, when the pilot pressure Pi (travel max) is in a relation of Pi (travel max)≦Pix, the energizing current in the straight-travel proportional valve 41 is the same as in FIG. 6A (Fd=1). On the other hand, when the pilot pressure Pi (travel max) exceeds the low-operation range Δ and becomes the predetermined value Pix or higher, the energizing current in the straight-travel proportional valve 41 decreases gradually from the current I1 (the current which holds the straight-travel valve 38 in the position E) down to the lower-limit current Imin which holds the straight-travel valve 38 in the neutral position D. When the energizing current in the straight-travel proportional valve 41 is of a magnitude between the current I1 and the lower-limit current Imin, the straight-travel valve 38 assumes a state intermediate between the neutral position D and the position E.

When the traveling 2R or 2L is in operation (Fa=1 or Fb=1), the controller 45 controls the regulator 21*a* for the pump 21 so that the discharge rate of the pump 21 which serves as a pressure oil supply source for both traveling motors 2R and 2L is varied in accordance with pilot pressures Pi (right-hand travel) and Pi (left-hand travel) related to the operating levers 43 which are associated with the traveling motors 2R and 2L. In this case, according to this embodiment, the regulator 21*a* is controlled in such a manner that, for example as indicated with a solid line in FIG. 7, the discharge rate of the pump 21 is increased gradually from a predetermined minimum flow rate Qmin up to a predetermined maximum flow rate Qmax as the total pilot pressure of pilot pressures Pi (right-hand travel) and Pi (left-hand travel), i.e., Pi (right-hand travel)+Pi (left-hand travel), increases above the minimum pressure Pis. As to the dot-dash line graph in FIG. 7, reference will be made later.

Further, when either the traveling motor 2R or 2L is in operation (Fa=1 or Fb=1) and with any of the working actuators 4 and 7~9 ON (Fd=1), the controller 45 controls the regulator 20*a* for the pump 20 so that the discharge rate of the pump 20 serving as a pressure oil supply source for the working actuators 4 and 7~9 is varied in accordance with pilot pressures Pi (work) related to the operating levers 43 which are associated with the working actuators 4 and 7~9. In this case, though not shown, for example as is the case with controlling the regulator 21*a* for the pump 21 described above, the regulator 20*a* for the pump 20 is controlled in accordance with the total sum of pilot pressures (work) corresponding to the working actuators 4 and 7~9 in such a manner that the discharge rate of the pump 20 is increased with an increase in the total sum of the said pilot pressures Pi (work). When the traveling motor 2R or 2L is in operation and with all of the working actuators 4 and 7~9 OFF (Fd=0), and when the pilot pressure Pi (right-hand travel) or the pilot pressure Pi (left-hand travel) is larger than the low-operation range Δ, the controller 45 controls the discharge rate of the pump 20 in accordance with the total sum of both pilot pressures Pi (right-hand travel) and Pi (left-hand travel) for example in the same form as the pump 21 (see FIG. 7).

When the traveling motor 2R or 2L is in operation (Fa=1 or Fb=1) and with any of the working actuators 4 and 7~9 ON (Fd=1), and when the boom cylinder 7 and the bucket cylinder 9 in group G1 are both OFF, the controller 45 makes control so that the cut-off valve 30 located most downstream of the center bypass passage 28 is closed through an electromagnetic proportional reducing valve (not shown). Likewise, in case of Fd=1 and when the rotating motor 4 and the arm cylinder 8 in group G2 are both OFF, the controller 45 makes control so that the cut-off valve 31 located most downstream of the center bypass passage 29 is closed through an electromagnetic proportional reducing valve (not shown).

The above energizing control for the right- and left-hand traveling proportional valves 39R, 39L and the straight-travel proportional valve 41, as well as the above control for the regulators 20*a* and 21*a* associated with the pumps 20 and 21, are executed successively by the controller 45 with a cycle time synchronized with the cycle time in the processing of FIG. 3 when the value of Flag Fa or Fb is set to "1" in the processing of FIG. 3, that is, when the traveling motor 2R or 2L is in operation.

By such controls conducted during operation of the traveling motor 2R or 2L, the hydraulic system of this embodiment operates in the following manner.

When the traveling motor 2R or 2L is in operation (including the case where both are ON simultaneously) and when the amount of operation of the operating lever 43 associated with the traveling motor 2R or 2L in operation is relatively small (when pilot pressure Pi travel max) lies in the low-operation range Δ), the straight-travel valve 38 is switched from its neutral position D to its position E and is held in the position E constantly irrespective of whether the working actuators 4 and 7~9 are ON or OFF. In this state, it is only the pump 21 that serves as a pressure oil supply source for the traveling motors 2R and 2L, and at the same time the pump 20 serves as a source for the supply of pressure oil to only the working actuators 4 and 7~9 through the working oil passage 40.

In this case, moreover, the traveling bypass cut-off valves 37R and 37L are each switched from the neutral position A to a position close to the position B or C, and the downstream sides of the bleed-off passages 27 in the direction control valves 22R and 22L for travel communicate with the oil tank 32 through the oil passages 37*a* in the traveling bypass cut-off valves 37R and 37L and are disconnected from the direction control valves 23~26 for work located downstream of the direction control valves 22R and 22L, so that the pressure oil flowing through the bleed-off passages 27 in the direction control valves 22R and 22L does not flow through the direction control valves 23~26 for work.

Therefore, even if any of the working actuators 4 and 7~9 is operated simultaneously with operation of the traveling motor 2R or 2L, the pressure oil fed from the pump 21 to the traveling motor 2R or 2L is not influenced by, for example, a change in pressure of the pressure oil fed from the pump 20 to any of the working actuators 4 and 7~9, nor are conducted switching operations of the straight-travel valve 38 and both bypass cut-off valves 37R and 37L in response to the start of operation of the working actuators 4 and 7~9 during travel of the hydraulic excavator. As a result, work such as excavation can be done by operation of the working actuators 4 and 7~9 while allowing the hydraulic excavator to travel at a relatively low, stable speed under the operation of traveling motors 2R or 2L.

In this case, in the direction control valve 22R or 22L associated with the traveling motor 2R or 2L is in operation, surplus oil flows to the oil tank 32 through the bleed-off passage 27 whose opening area varies according to the amount of operation of the associated operating lever 43. Besides, the discharge rate of the pump 21 serving as a pressure oil supply source for the traveling motor 2R or 2L is controlled so as to become smaller as the amount of operation of the operating lever 43 associated with the traveling motor 2R or 2L decreases. Consequently, pressure oil can be fed to the energized traveling motor 2R or 2L at a flow rate proportional to the amount of operation of the operating lever 43, making the most of the opening area characteristic of the bleed-off passage in the direction control valve 22R or 22L for travel. Thus, the operation for a stable traveling speed can be done smoothly.

In the case where the operating lever 43 associated with the traveling motor 2R or 2L is operated relatively largely (more specifically, in case of max (Pi (right-hand travel), Pi (left-hand travel)>Pix), the straight-travel valve 38 is switched from the position E to the neutral position D, so that basically pressure oils from the pumps 21 and 20 can be fed to the traveling motors 2R and 2L respectively. Therefore, a high traveling speed required for the hydraulic excavator can be ensured to a satisfactory extent.

Further, when any of the working actuators 4 and 7~9 is operated in such a high-speed traveling state of the hydraulic excavator, the straight-travel valve 38 is switched to the position F side. At this time, the pump 21 serves as a main pressure oil supply source for the traveling motors 2R and 2L and the pump 20 serves as a main pressure oil supply source for the working actuators 4 and 7~9, but a portion of the pressure oil from the pump 20 is fed to the traveling motors 2R and 2L through the throttle passage 38*a* at position F of the straight-travel valve 38. Consequently, it is possible to avoid a sudden deceleration of the hydraulic excavator. In the position F of the straight-travel valve 38, the pressure oil fed to the working actuators 4 and 7~9 and the pressure oil fed to the traveling motors 2R and 2L somewhat interfere with each other through the throttle passage 38*a* in the straight-travel valve 38. But this interference will cause no practical trouble because the rate of variation in the traveling speed caused by the interference is smaller in high-speed travel than in low-speed travel of the hydraulic excavator.

When only one of the traveling motors 2R and 2L is in operation, for example when the traveling motor 2R is ON, the traveling bypass cut-off valve 37L on the traveling motor 2L side which is OFF is switched to a position close to C rather than position B and the oil passage 37*a* in the traveling bypass cut-off valve 37L, which provides communication of the center bypass passage 29 located upstream of the traveling bypass cut-off valve 37L with the oil tank 32, tends to close. Thus, there is no fear that a portion of pressure oil from the pump 21 may flow in a too large amount through the straight-travel valve 38 to the center bypass passage 29 side which is different from the center bypass passage 28 located on the traveling motor 2R side which is in operation. Consequently, the pressure oil from the pump 21 can be fed sufficiently to the traveling motor 2R in operation.

When the traveling motor 2R or 2L and any of the working actuators 4 and 7~9 are operated simultaneously, pressure oil is fed from the pump 20 to the working actuators 4 and 7~9 through the working oil passage 40. At this time, a surplus portion of the pressure oil fed through the working oil passage 40 to the working actuator in operation passes through the bleed-off passage 27 in the direction control valve associated with the working actuator in operation and flows to the oil tank 32. Thus, making the most of the opening area characteristics of the bleed-off passages 27 in the direction control valves 23~26 associated with the working actuators 4 and 7~9, pressure oil can be fed to the working actuators 4 and 7~9 under operation at flow rates proportional to the amounts of operation of the associated operating levers 43, whereby the working actuators 4 and 7~9 can be operated smoothly.

The following description is now provided about the operation performed in response to operation of the operating volume 46 (see FIG. 2) from position "OFF" to position "ON." In this embodiment, when the operating volume 46 is operated to "ON" position side, a characteristic of the energizing control for the straight-travel proportional valve 41 with Flag Fd=1 (in the simultaneous operation of the traveling motor 2R or 2L and any of the working actuators 4 and 7~9) and a characteristic of control for the discharge rate of the pump 21 are set variably.

More specifically, with reference to FIG. 6A, when the operating volume 46 is operated to "ON" position side, the controller 45 makes control, as indicated with dot-dash lines in the same figure, in such a manner that when the pilot pressure Pi (max of travel) is not lower than the predetermined value Pix (when the amount of operation of the operating level 43 associated with the traveling motor 2R or 2L is relatively large), the energizing current for the straight-travel valve 41 for the pilot pressure Pi (max of travel) is made smaller than in case of the operating volume 46 being operated to "OFF" position, and that the larger the amount of operation of the operating volume 46 to the "ON" position side, the smaller is made the said energizing current. Particularly, when the operating volume 46 is operated to a maximum degree, as indicated with a dot-dash line "a" in the figure, the energizing current for the straight-travel proportional valve 41 is maintained at current I1 which holds the straight-travel valve 38 at position E, independently of pilot pressure Pi (travel max), when the pilot pressure Pi (travel max) is not lower than the minimum pressure Pis.

Figure 7:
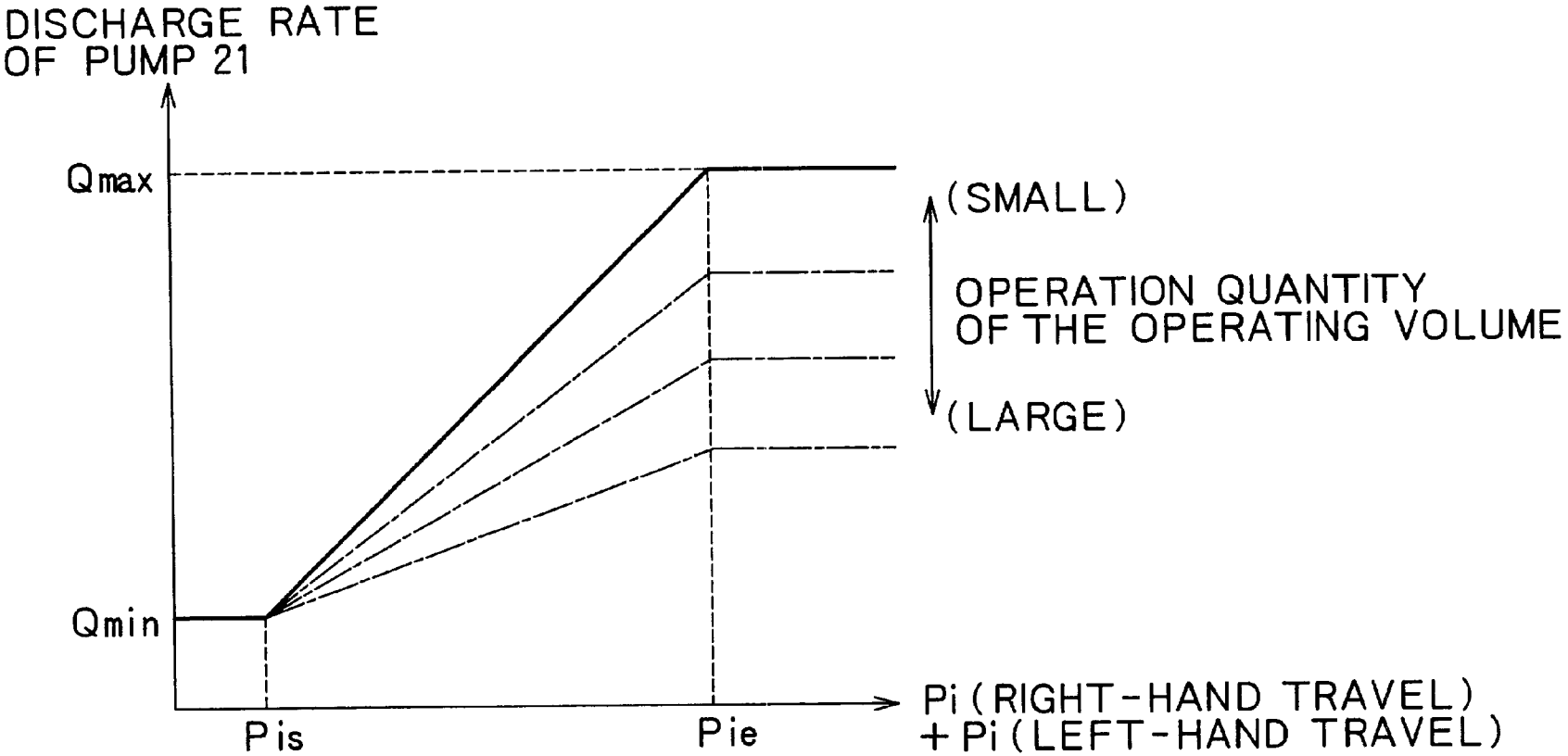
FIG. 7 is a diagram for explaining the operation of the hydraulic system of FIG. 1.

Referring to FIG. 7, when the operating volume 46 is operated to "ON" position side, the controller 45 controls the regulator 21*a* for the pump 21 so that the discharge rate of the pump 21 for the pilot pressure Pi (right-hand travel)+Pi (left-hand travel) becomes smaller than in case of the operating volume 46 being operated to "OFF" position. In this case, the controller 45 makes control so that the larger the amount of operation of the operating volume 46, the smaller the discharge rate of the pump 21.

Since control is thus made according to operations of the operating volume 46, when the operating volume 46 is operated to "ON" position side and when the traveling motor 2R or 2L and any of the working actuators 4 and 7~9 are operated simultaneously, the straight-travel valve 38 is controlled to a position closer to position E rather than position F even if the amount of operation of the operating lever 43 associated with the traveling motor 2R or 2L which is in operation is made relatively large. Particularly, when the operating volume 46 is operated to a maximum degree, the straight travel valve 38 is held in position E independently of the amount of operation of the operating lever 43 for travel.

Consequently, it is no longer necessary to hold the operating lever 43 for travel in the range corresponding to the foregoing low-operation range in order to avoid interference at position F of the straight travel valve 38 between the pressure oil fed to the working actuators 4, 7~9 and the pressure oil fed to the traveling motors 2R, 2L. Thus, the above interference can be avoided under a relatively rough operation of the operating lever 43.

At this time, even if the operating lever 43 for travel is operated to a large extent, the traveling speed of the hydraulic excavator is kept to a low speed because the discharge rate of the pump 21 serving as a pressure oil supply source for the traveling motors 2R and 2L is kept to a small value. Consequently, it is possible to easily effect the operation for operating the working actuators 4 and 7~9 while ensuring a stable traveling speed of the hydraulic excavator.

In this embodiment, when the values of Flags Fa and Fb are both "0" (with both traveling motors 2R and 2L OFF), the right- and left-hand traveling proportional valves 39R, 39L and the straight-travel proportional valve 41 are subjected to an energizing control so as to respectively hold the traveling bypass cut-off valves 37R, 37L and the straight-travel valve 38 at their neutral positions. Therefore, when the working actuators 4 and 7~9 are operated with both traveling motors 2R and 2L OFF, basically pressure oil is fed from the pump 21 to the working actuators 7 and 9 in group G1 and pressure oil is fed from the pump 20 to the working actuators 4 and 8 in group G2.

In this case, for example when the operating lever 43 associated with the boom cylinder 7 is operated in a large amount of operation (an approximately maximum amount of operation), the boom confluence valve 36 is controlled to an open condition by the controller 45 through an electromagnetic proportional reducing valve (not shown) and the cut-off valve 31 is controlled to a closed condition by the controller 45 through an electromagnetic proportional reducing valve (not shown), whereby the pressure oil from both pumps 20 and 21 are joined and fed to the boom cylinder 7. Likewise, when the operating lever 43 associated with the arm cylinder 8 is operated in a large amount of operation (an approximately maximum amount of operation), the arm confluence valve 35 is controlled to an open condition by the controller 45 through an electromagnetic proportional reducing valve (not shown) and the cut-off valve 30 is controlled to a closed condition by the controller 45 through an electromagnetic proportional reducing valve, whereby the pressure oil from both pumps 20 and 21 are joined and fed to the boom cylinder 7.

Figure 8:
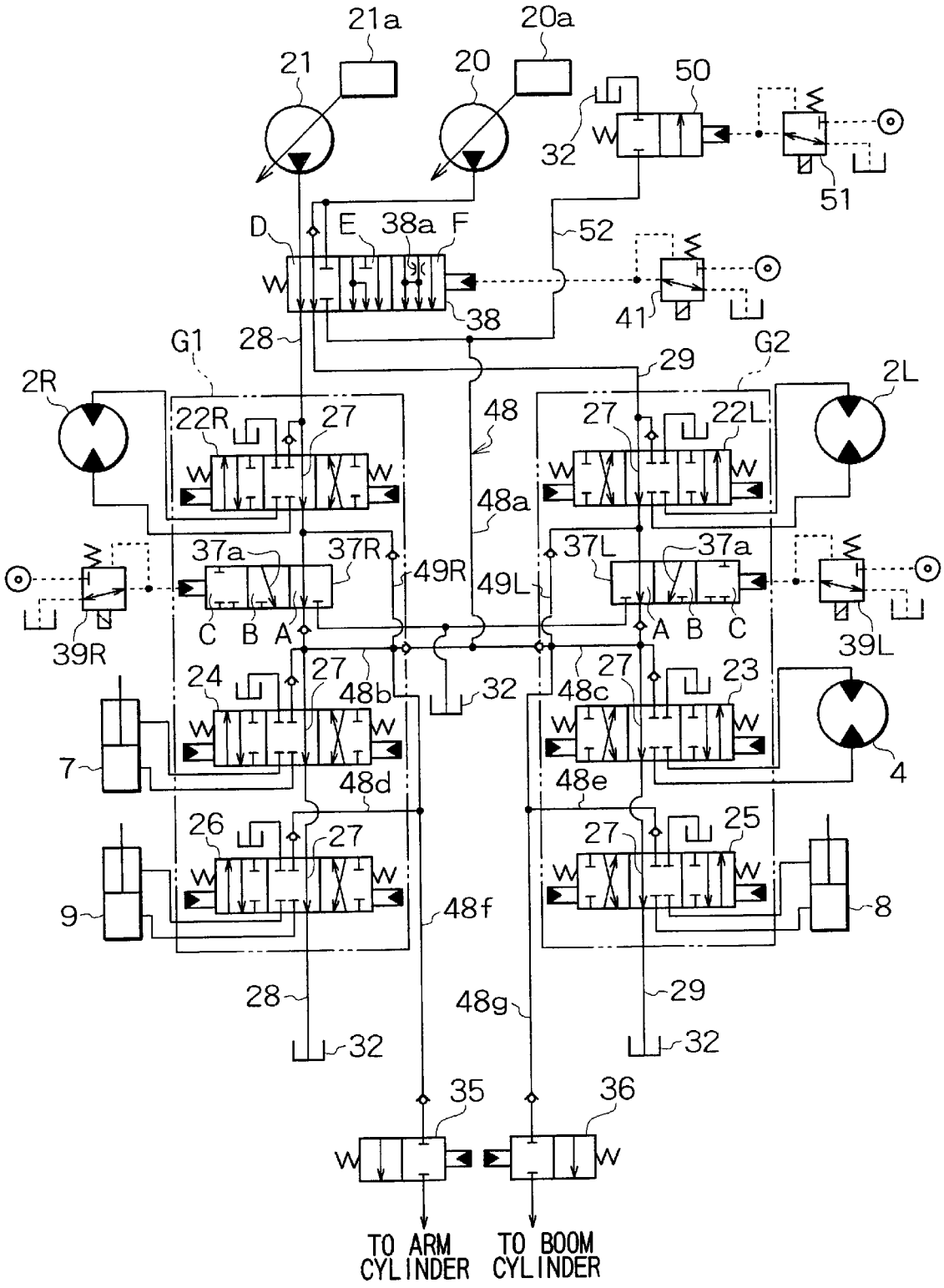
FIG. 8 is a circuit configuration diagram of a hydraulic system according to a second embodiment of the present invention.

A second embodiment of the present invention will be described below with reference to FIGS. 8 and 9. This embodiment is different only partially in construction from the previous first embodiment, so the same constructional portions as in the first embodiment are identified by the same reference numerals as in the first embodiment and explanations thereof will here be omitted. This embodiment is related to the foregoing first mode of the present invention.

A hydraulic system of this embodiment is provided with a working oil passage 48 of a different connectional construction from that used in the first embodiment. The working oil passage 48 comprises a main passage 48*a* connected to the straight-travel valve 38 and plural branch passages 48*b*~48*g* branched from the main passage 48*a*. Of the branch passages 48*b*~48*g*, the branch passages 48*b*, 48*c*, 48*d*, and 48*e* are connected respectively to inlet ports of meter-in passages in the direction control valve 24 for boom, direction control valve 23 for rotation, direction control valve 26 for bucket, and direction control valve 25 for arm. The branch passages 48*f* and 48*g* are connected to inlet ports of the arm confluence valve 35 and boom confluence valve 36 respectively. An oil passage 49R branched from the center bypass passage 28 at a position between the direction control valve 22R for right-hand travel and the traveling bypass cut-off valve 37R located downstream of the valve 22R is connected into communication with upstream portions of the branch passages 48*b*, 48*d*, and 48*f* located on the first group G1 side, while an oil passage 49L branched from the center bypass passage 29 at a position between the direction control valve 22L for left-hand travel and the traveling bypass cut-off valve 37L located downstream of the valve 22L is connected into communication with upstream portions of the branch passages 38*c*, 48*e*, and 48*g* located on the second group G2 side.

The hydraulic system of this system is further provided with an unloading valve 50 for work which can open the main passage 48 of the working oil passage 48 to the oil tank 32 and an electromagnetic proportional reducing valve 51 for actuating the unloading valve 50 for work. The unloading valve 50 for work is a control valve (spool valve) which can open and close and which can adjust the area of its opening. An inlet port of the unloading valve 50 is connected to an oil passage 52 which is branched from the main passage 48*a* on the upstream side of the branch passages 48*b*~48*g* of the working oil passage 48, and an outlet port thereof is put in communication with an oil tank 32. The unloading valve 50 for work is closed in a neutral state thereof. The electromagnetic proportional reducing valve 51 ("working proportional valve 51" hereinafter) is of the same structure as the proportional valves 39R, 39L, and 41 described in the first embodiment and is connected to a pilot port of the unloading valve 50 for work.

The cut-off valves 30 and 31 disposed in the center bypass passages 28 and 29 respectively in the first embodiment are not used in this first embodiment The other constructional portions of the hydraulic system of this embodiment are the same as in the first embodiment. Like the first embodiment, the hydraulic system of this embodiment illustrated in FIG. 8, for controlling the operation thereof, is provided with the operation quantity detector 44, controller 46, and operating volume 46 which are illustrated in FIG. 2. But in this embodiment, though not shown, the controller 45 can make an energizing control for the working proportional valve 51 in addition to the proportional valves 39R, 39L, 41 and the regulators 20*a*, 21*a* for the pumps 20, 21 described in the first embodiment.

Reference will now be made to the operation of the hydraulic system of this embodiment. In this embodiment, as in the first embodiment, the controller 45 executes the setting of Flags Fa~Fd in a successive manner. Then, in accordance with the values of Flags Fa~Fd the controller 45 makes an energizing control for each of the right- and left-hand traveling proportional valves 39R, 39L, the straight-travel proportional valve 38, and the regulators 20*a* and 21*a* for the pumps 20 and 21 in the same way as in the first embodiment, allowing the traveling bypass cut-off valves 37R and 37L and the straight-travel valve 38 to operate and controlling the discharge rate of the pumps 20 and 21 as described in the first embodiment.

Figure 9:
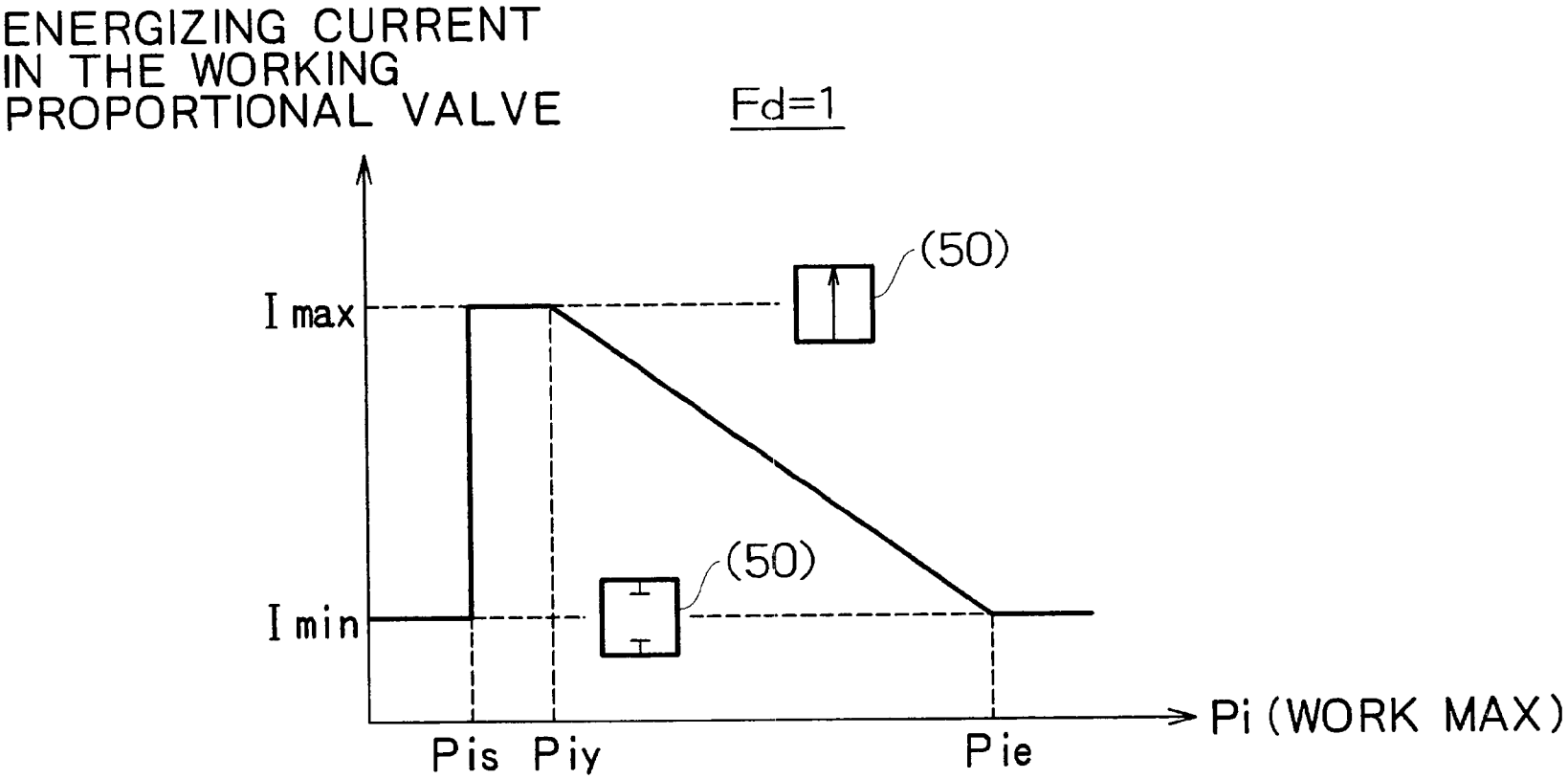
FIG. 9 is a diagram for explaining the operation of the hydraulic system of FIG. 8.

On the other hand, with Fd=1, namely, in the simultaneous operation of the traveling motor 2R or 2L and any of the working actuators 4 and 7~9, the controller 45 determines an energizing current for the working proportional valve 51 with reference to a data table built in advance, as in FIG. 9, and in accordance with a maximum pilot pressure Pi (work max) out of pilot pressures Pi (work) which represent the amounts of operation of the operating levers 43 associated with the working actuators 4 and 7~9 respectively. The controller 45 then supplies the thus-determined energizing current to the working proportional valve 51, causing the unloading valve 50 for work to operate.

In the data table of FIG. 9, when the pilot pressure Pi (work max) becomes a predetermined minimum pressure Pis or higher, the energizing current in the working proportional valve 51 increases from a predetermined lower-limit current Imin which holds the unloading valve 50 for work in a closed state to an upper-limit current Imax which switches the unloading valve 50 to a fully open condition in an instant and holds it in that condition. The energizing current in the working proportional valve 51 is held at the upper-limit current Imax until the pilot pressure Pi (work max) rises to a predetermined pressure Piy which is a little higher than the minimum pressure Pis, and thereafter decreases gradually from the upper-limit current Imax to the lower-limit current Imin with an increase of the pilot pressure Pi (work max) (an increase in the amount of operation of the associated operating lever 43). In this case, the opening area of the unloading valve 50 for work becomes smaller with a decrease of the energizing current in the working proportional valve 51.

With Fd=0 (when the traveling motor 2R or 2L is ON and any of the working actuators 4 and 7~9 is OFF), the controller 45 supplies the upper-limit current Imax to the working proportional valve 51 which current holds the unloading valve 50 for work in a fully open condition. When both traveling motors 2R and 2L are OFF, the controller 45 supplies the lower-limit current Imin to the working proportional valve 51 which current holds the unloading valve 50 in a closed condition.

By operation of the unloading valve 50 for work responsive to such energizing control for the working proportional valve 51, bleed-off for the working actuators 4 and 7~9 in operation is performed through the unloading valve 50 in the simultaneous operation of the traveling motor 2R or 2L and any of the working actuators 4 and 7~9.

Thus, in the simultaneous operation (Fd=1) in this embodiment, pressure oil does not flow through the bleed-off passages 27 in the direction control valves 23~26 corresponding to the working actuators 4 and 7~9, but a surplus portion of pressure oil fed from the pump 20 serving as a pressure oil supply source for the working actuators 4 and 7~9 to the working oil passage 48 through the straight-travel valve 38 flows from the main passage 48*a* of the working oil passage 48 to the oil tank 32 through the oil passage 52 and the unloading valve 50 for work. At this time, the area of opening of the unloading valve 50 becomes smaller as the amount of operation of the operating lever 43 associated with the working actuator which is in operation increases (as the pilot pressure Pi (work max) increases), whereby bleed-off for the working actuators 4 and 7~9 is effected appropriately in the above simultaneous operation (Fd=1) and the working actuators 4 and 7~9 can be operated smoothly. Other operations (including the operation performed upon operation of the operating volume 46) and functions and effects are the same as in the first embodiment.

In this embodiment, for example when the operating lever 43 associated with the boom cylinder 7 is operated in a large amount of operation, with the traveling motors 2R and 2L OFF, and when pressure oils from both pumps 20 and 21 are joined and fed to the boom cylinder 7 ("boom joining operation" hereinafter) as described in the first embodiment, the controller 45 causes the boom confluence valve 36 to open as in the first embodiment and makes an energizing control for the left-hand traveling proportional valve 39L so as to hold the traveling bypass cut-off valve 37L in position C. Likewise, when the operating lever 43 associated with the arm cylinder 8 is operated in a large amount of operation and pressure oils from both pumps 20 and 21 are joined and fed to the arm cylinder 8 ("arm joining operation" hereinafter), the controller 45 causes the arm confluence valve 35 to open as in the first embodiment and holds the traveling bypass cut-off valve 37R in position C. Thus, the cut-off valves 30 and 31 used in the first embodiment are not necessary in this second embodiment.

Figure 10:
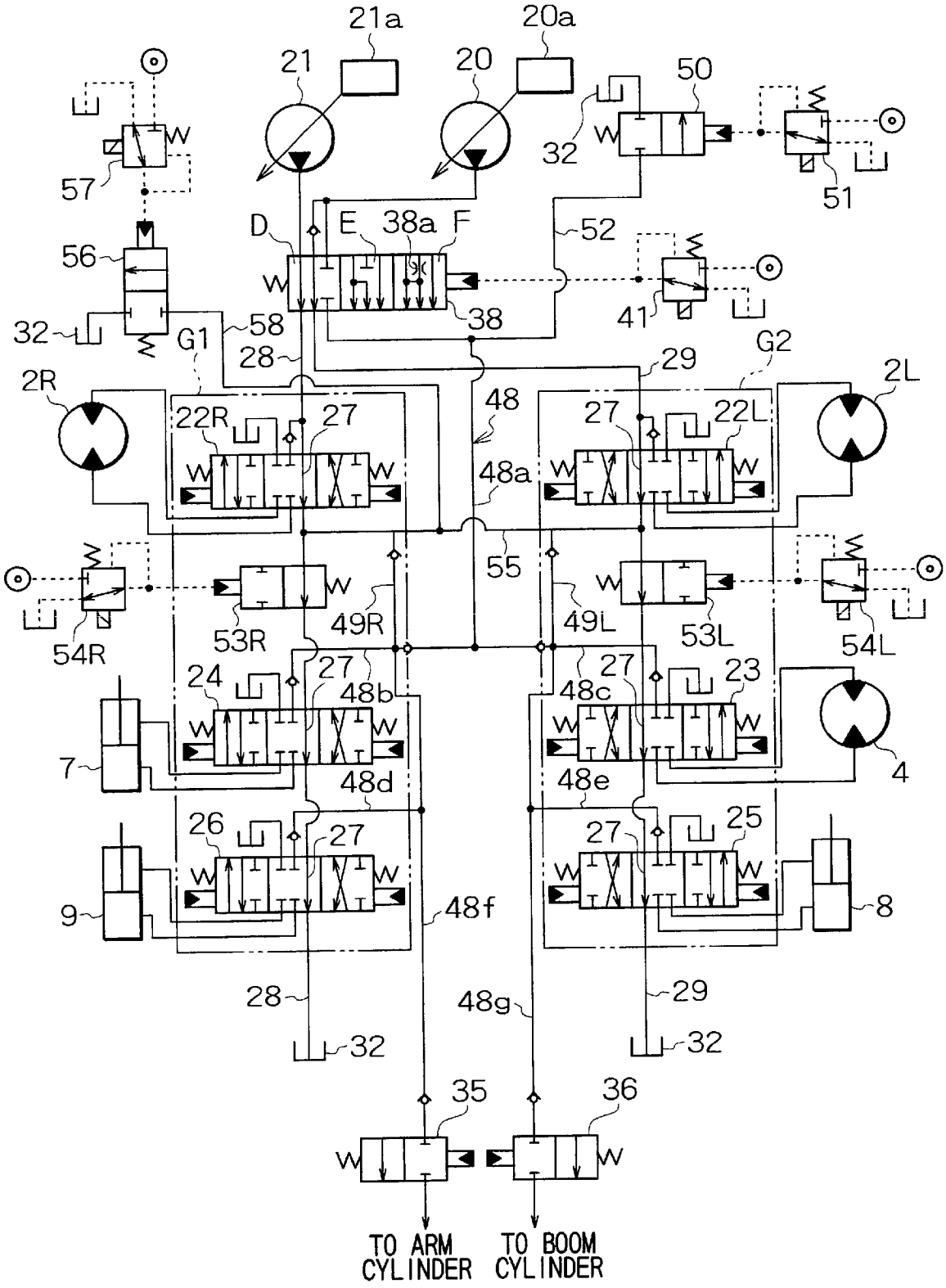
FIG. 10 is a circuit configuration diagram of a hydraulic system according to a third embodiment of the present invention.

A third embodiment of the present invention will now be described with reference to FIGS. 10 and 11. This second embodiment is different only partially in construction from the previous second embodiment, so the same constructional portions as in the second embodiment are identified by the same reference numerals as in the second embodiment and explanations thereof will here be omitted. This embodiment is related to the foregoing first mode of the present invention.

In this embodiment, instead of the traveling bypass cut-off valves 37R and 37L used in the second embodiment, traveling bypass cut-off valves 53R and 53L which can merely open and close are disposed in the center bypass passages 28 and 29 respectively. The traveling bypass cut-off valves correspond to the cut-off valve in the foregoing first mode of the present invention and are open in their neutral state. A right-hand traveling proportional valve 54R and a left-hand proportional valve 54L, which are constituted by electromagnetic proportional reducing valves of the same structures as the right- and left-hand traveling proportional valves 39R and 39L, are connected respectively to pilot ports of the traveling bypass cut-off valves 53R and 53L.

In this embodiment, the center bypass passage 28 between the right-hand traveling direction control valve 22R and the traveling bypass cut-off valve 53R located downstream of the valve 22R and the center bypass passage 29 between the left-hand traveling direction control valve 22L and the traveling bypass cut-off valve 53L located downstream of the valve 22L are connected into communication with each other through an oil passage 55. The hydraulic system of this embodiment is further provided with an unloading valve 56 for travel which can open the oil passage 55 to an oil tank 32 and an electromagnetic proportional reducing valve 57 for actuating the unloading valve 56.

The unloading valve 56 for travel is a control valve (spool valve) which-can open and close and which can adjust the area of its opening. An inlet port of the unloading valve 56 is connected into communication with the oil passage 55 through an oil passage 58 and an outlet port thereof is put in communication with the oil tank 32. The unloading valve 56 for travel, which is closed in its neutral state, corresponds to the opening valve in the foregoing first mode of the present invention. The electromagnetic proportional reducing valve 57 ("traveling proportional valve 57" hereinafter) is of the same structure as the straight-travel proportional valve 41 and is connected to a pilot port of the unloading valve 56 for travel.

The other constructional portions than above of the hydraulic system of this embodiment are the same as in the second embodiment. Further, in this embodiment, for controlling the hydraulic system illustrated in FIG. 10, there are provided such operation quantity detector 44, controller 46 and operating volume 46 as are illustrated in FIG. 2, like the first and second embodiments. But in this embodiment, though not shown, the controller 45 can make an energizing control for the straight-travel proportional valve 41, right- and left-hand proportional valves 53R, 54L, traveling proportional valve 56, working proportional valve 51, and regulators 20*a* and 21*a* for the pumps 20 and 21.

The following description is now provided about the operation of the hydraulic system of this embodiment. In this embodiment, as in the second embodiment, the controller 45 executes the setting of Flags Fa~Fd in a successive manner. In accordance with the values of Flags Fa~Fd the controller 45 makes an energizing control for each of the straight-travel proportional valve 38, the working proportional valve 51, and the regulators 20*a* and 21*a* for the pumps 20 and 21 in the same manner as in the second embodiment, allowing the straight-travel valve 38 and the unloading valve 50 for work to operate and controlling the discharge rate of the pumps 20 and 21 as described in the first embodiment.

On the other hand, in case of Fa=1 or Fb=1, namely, the traveling motor 2R or 2L is in operation, the controller 45 makes control to supply an energizing current (upper-limit current) which holds both traveling bypass cut-off valves 53R and 53L in a closed condition to the right- and left-hand traveling proportional valves 54R, 54L independently of pilot pressures Pi (right-hand travel) (>Pis) and Pi (left-hand travel) (>Pis) which are related to the amount of operation of the operating lever 43 for travel.

Figure 11A:
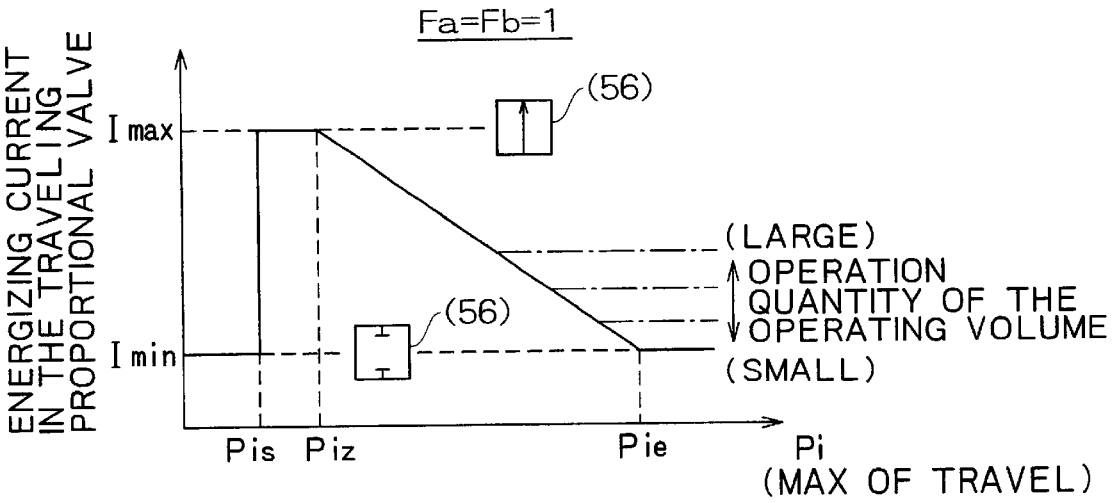
FIGS. 11A, 11B are diagrams for explaining the operation of the hydraulic system of FIG. 10.
Figure 11B:
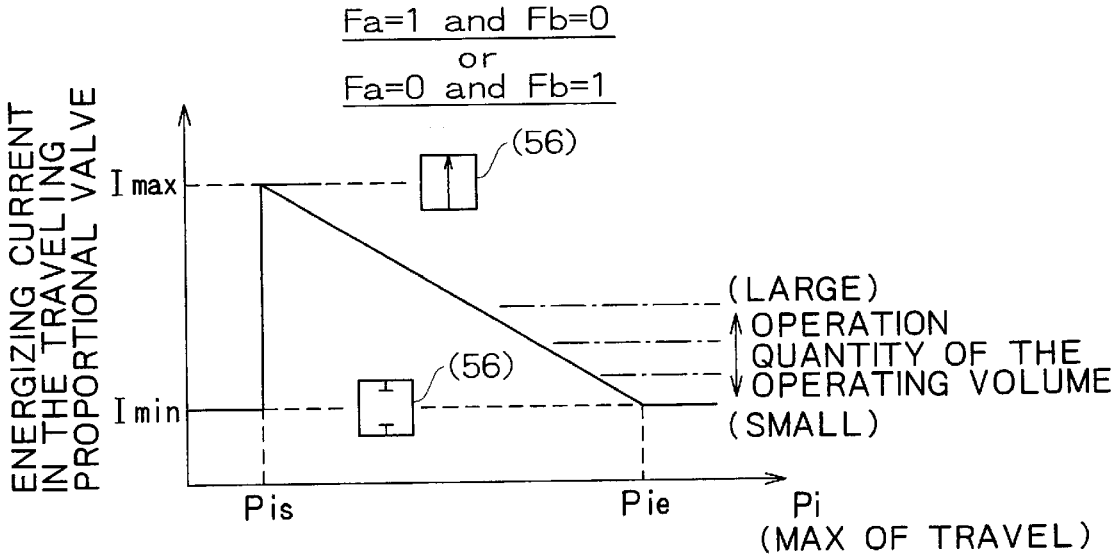

Further, with reference to a data table built in advance, as indicated with a solid line in FIG. 11A or 11B, the controller 45 determines an energizing current for the traveling proportional valve 57 in accordance with the higher pilot pressure Pi (travel max)=max (Pi(right-hand travel), Pi(left-hand travel)) out of pilot pressures Pi(right-hand travel) (>Pis) and Pi(left-hand travel) (>Pis). The controller 45 then supplies the thus-determined energizing current to the traveling proportional valve 57, causing the unloading valve 56 for travel to operate. The data table indicated with a solid line in FIG. 11A is to be used when both traveling motors 2R and 2L are in operation (Fa=Fb=1), while the data table indicated with a solid line in FIG. 11B is to be used when only one of the traveling motors 2R and 2L is in operation (Fa=1 and Fb=0, or Fa=0 and Fb=1).

The dot-dash line graphs in FIGS. 11A and 11B are concerned with the case where the operating volume 46 is operated to "ON" position. On this regard, a description will be given later. Here it is assumed that the operating volume 46 is operated to "OFF" position.

In the data table indicated with a solid line in FIG. 11A, when the pilot pressure Pi (travel max) becomes a predetermined minimum pressure Pis or higher, the energizing current in the traveling proportional valve 57 increases from a predetermined lower-limit current Imin which holds the unloading valve 56 for travel in a closed condition to an upper-limit current Imax which switches the unloading valve 56 to a fully closed condition in an instant and holds it in that condition. The energizing current in the traveling proportional valve 57 is held in the upper-limit current Imax until the pilot pressure Pi (travel max) rises to a predetermined pressure Piz which is higher than the minimum Pis, then decreases gradually from the upper-limit current Imax to the lower-limit current Imin with an increase of the pilot pressure Pi (work max) (an increase in the amount of operation of the operating lever 43 for travel). In this case, the area of opening of the unloading valve 56 for travel becomes smaller as the energizing current in the traveling proportional valve 57 decreases.

In the data table of FIG. 11B, when the pilot pressure Pi (travel max) becomes a predetermined minimum pressure Pis or higher, the energizing current in the traveling proportional valve 57 increases from a predetermined lower limit Imin which holds the unloading valve 56 for travel in a closed condition to an upper-limit current Imax which switches the unloading valve 56 to a fully open condition in an instant. Thereafter, as the pilot pressure Pi (work max) increases (as the amount of operation of the operating lever 43 for travel increases), the energizing current in the traveling proportional valve 57 decreases gradually from the upper-limit current Imax to the lower-limit current Imin. Consequently, with an increase of pilot pressure Pi (work max), the area of opening of the unloading valve 56 for travel becomes smaller more rapidly than in case of using the data table of FIG. 11A (Fa=Fb=1). This for preventing the operating pressure of the traveling motor 2R from becoming higher in the operation of only one of the traveling motors 2R and 2L, e.g., only 2R, than in the operation of both traveling motors 2R and 2L and for preventing the resultant deepening (increase in the amount of operation) of the operation lever 43 associated with the traveling motor 2R which is in operation.

By such operations of the bypass cut-off valves 53R, 53L and the unloading valve 56 for travel responsive to the energizing control for the right-traveling proportional valves 54R, 54L and the unloading valve 56 for travel, in the operation of the traveling motor 2R or 2L, the downstream sides of bleed-off passages 27 in the traveling direction control valves 22R and 22L come into communication with the oil tank 32 through the unloading valve 56 and are disconnected from the working direction control valves 23~26 located downstream of the direction control valves 22R and 22L by means of the traveling bypass cut-off valves 53R and 53L which are closed, so that the pressure oil flowing through the bleed-off passages 27 in the direction control valves 22R and 22L does not flow through the working direction control valves 23~26. Thus, the traveling bypass cut-off valves 53R, 53L and the unloading valve 56 for travel used in this embodiment fulfill the same function as that of the traveling bypass cut-off valves 37R and 37L used in the first and second embodiments. In the hydraulic system of this embodiment, the other constructions and operations than those of the traveling bypass cut-off valves 53R, 53L and the unloading valve 56 for travel are the same as in the second embodiment. Therefore, also in this embodiment there can be attained the same functions and effects as in the second embodiment.

In this embodiment, when the operating volume 46 is operated from position "OFF" to position "ON," the controller 45 supplies the traveling proportional valve 57 with such an energizing current as keeps the opening area of the unloading valve 56 for travel at a constant opening area in a relatively high pilot pressure Pi (travel max), as indicated with dot-dash lines in FIGS. 11A and 11B. In this case, the larger the amount of operation of the operating volume 46, the larger the energizing current in the traveling proportional valve 57.

By so doing, not only there are performed such discharge rate control for the pump 21 and operation control for the straight-travel valve 38 responsive to operations of the operating volume 46 as described in the first embodiment, but also the operating speed of the traveling motors 2R and 2L can be kept to a low speed effectively even if the associated operating lever 43 for travel is operated relatively largely. As a result, operations for operating the working actuators 4 and 7~9 can be done easily while ensuring a stable speed of the hydraulic excavator.

In this embodiment, when the traveling motors 2R and 2L are OFF, the unloading valve 56 for travel is held in its closed state (neutral state). Then, in the foregoing boom joining operation, the controller 45 causes the boom confluence valve 36 to open in the same manner as in the first embodiment and makes an energizing control for the left-hand traveling proportional valve 54L so as to keep the traveling bypass cut-off valve 53L closed. Likewise, in the foregoing arm joining operation, the controller 45 causes the arm confluence valve 35 to open in the same manner as in the first embodiment and holds the traveling bypass cut-off valve 53R in a closed condition. Thus, also in this embodiment, like the second embodiment, the cut-off valves 30 and 31 used in the first embodiment are not necessary.

Although in this embodiment the unloading valve 56 for travel is used in common to both traveling motors 2R and 2L, separate unloading valves for travel may be connected to the downstream sides of the bleed-off passages 27 of the traveling direction control valves 22R and 22L (upstream sides of the traveling bypass cut-off valves 53R and 53L). In this case, when both traveling motors 2R and 2L are in operation, the separate unloading valves may be operated according to pilot pressures Pi (right-hand travel) and Pi (left-hand travel) corresponding respectively to the traveling motors 2R and 2L for example with such a characteristic as shown in FIG. 11A. When only one of the traveling motors 2R and 2L is in operation, for example when the traveling motor 2R is in operation, the unloading valve for travel associated with the traveling motor 2R which is in operation is operated according to pilot pressure Pi (right-hand travel) with such a characteristic as shown in FIG. 11A, while the unloading valve for travel associated with the traveling motor 2L which is OFF is held in a closed condition.

Figure 12:
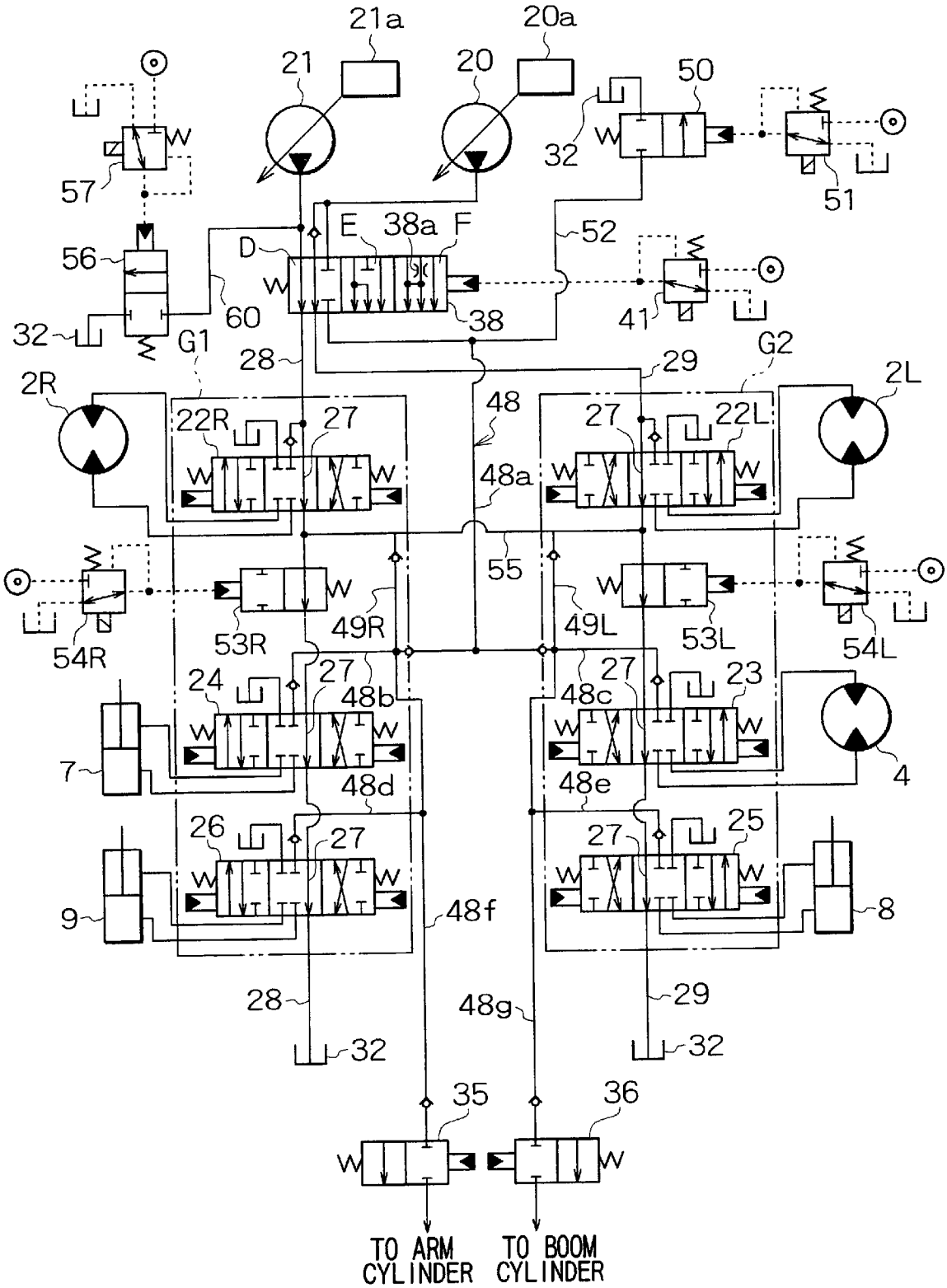
FIG. 12 is a circuit configuration diagram of a hydraulic system according to a fourth embodiment of the present invention.
Figure 13:
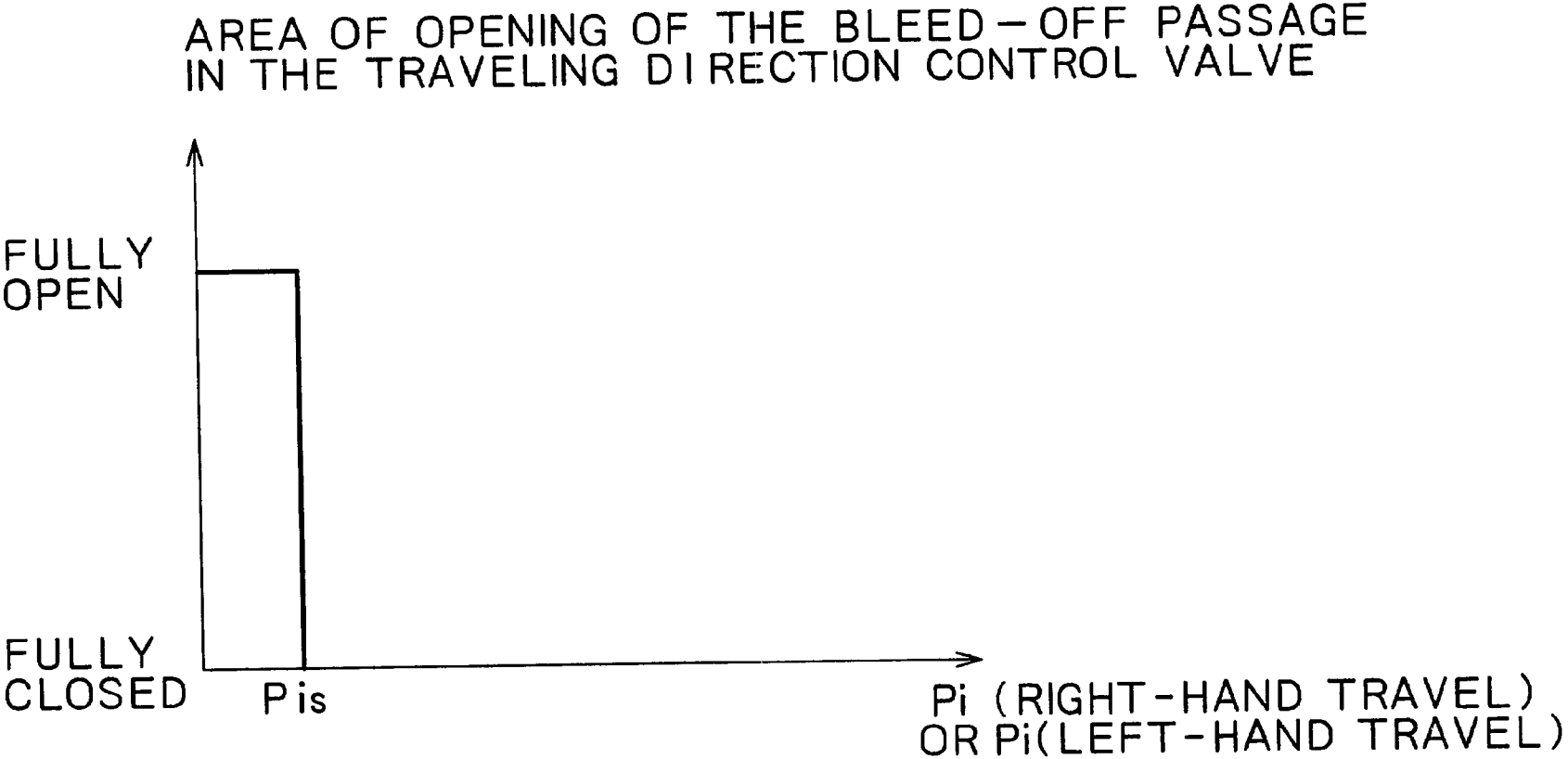
FIG. 13 is a diagram for explaining the operation of the hydraulic system of FIG. 12.

Next, a fourth embodiment of the present invention will be described with reference to FIGS. 12 and 13. This embodiment is different only partially in construction from the previous third embodiment, so the same constructional portions as in the third embodiment are identified by the same reference numerals as in the third embodiment and explanations thereof will here be omitted. This embodiment is related to the foregoing second mode of the present invention.

In this embodiment, the spool shape of traveling direction control valves 22RR and 22LL and an elastic force characteristic of a return spring (a spring for urging to a neutral position) are set beforehand so that the bleed-off passages 27 in the direction control passages 22RR and 22LL vary in the area of opening in accordance with pilot pressures Pi (right-hand travel) and Pi (left-hand travel) which are applied to pilot ports of the valves 22RR and 22LL. More specifically, when the pilot pressures Pi (right-hand travel) and Pi (left-hand travel) proportional to operations of the associated operating levers 43 become a minimum pressure Pis at which the direction control valves 22RR and 22LL for travel are switched into operation, the bleed-off passages 27 in the direction control valves 22RR and 22LL assume a fully closed state immediately from a fully open state and are thereafter held in the fully closed state independently of an increase of pilot pressures Pi (right-hand travel) and Pi (left-hand travel). Immediately after the bleed-off passages 27 were put in the fully closed state, meter-in passages in the direction control valves 22RR and 22LL become larger in their opening area with an increase of pilot pressures Pi (right-hand travel) and Pi (left-hand travel).

In this embodiment, an unloading valve 56 for travel, which corresponds to the opening valve in the foregoing second mode of the present invention, is connected to an oil passage 59 extending from the pump 21 to the straight-travel valve 38, through an oil passage 60 branched from the oil passage 59. The other constructional portions than above are just the same as in the previous third embodiment.

Next, the operation of the hydraulic system of this embodiment will be described. In this embodiment, as in the third embodiment, the controller 45 executes the setting of Flags Fa~Fd in a successive manner, then in accordance with the values of Flags Fa~Fd the controller 45 makes an energizing control for the straight-travel valve 38, the working proportional valve 51, and the regulators 20*a* and 21*a* for the pumps 20 and 21, causing the straight-travel valve 38 and the unloading valve 50 for work to operate, and controls the discharge rate of the pumps 20 and 21.

On the other hand, in case of Fa=1 or Fb=1, namely, when either the traveling motor 2R or 2L is in operation, the controller 45 supplies the left-hand traveling proportional valve 54L with an energizing current (upper-limit current) which holds the traveling bypass cut-off valve 53L associated with the left-hand traveling motor 2L in a closed state when only the traveling motor 2R is in operation (Fa=1 and Fb=0), while when only the traveling motor 2L is in operation (Fa=0 and Fb=1), the controller 45 supplies the right-hand traveling proportional valve 54R with an energizing current (upper-limit current) which holds the traveling bypass cut-off valve 53R associated with the right-hand traveling motor 2R in a closed state. Thus, the traveling bypass cut-off valve 53R or 53L associated with the traveling motor 2R or 2L which is OFF is closed when only one of the traveling motors 2R and 2L is ON, whereby the pressure oil from the pump 21 flows through the center bypass passage 28 or 29 associated with the traveling motor 2R or 2L which is OFF and what is called pressure relief is prevented thereby.

The bleed-off passage 27 in the direction control valve 22R or 22L associated with the traveling motor 2R or 2L which is in operation is fully closed, therefore, the state of the traveling bypass cut-off valve 53R in case of Fa=1 and Fb=0, the state of the traveling bypass cut-off valve 53L in case of Fa=0 and Fb=1, and the state of both traveling bypass cut-off valves 53R and 3L in case of Fa=Fb=1 (both traveling motors 2R and 2L are ON), are not specially limited. In this embodiment, they are closed states for example. As in the third embodiment, both traveling bypass cut-off valves 53R and 53L may be kept closed in case of Fa=1 or Fb=1.

With Fa=1 or Fb=1, the controller 45 determines the foregoing energizing current for the traveling proportional valve 57 with reference to, for example, the data table of FIG. 11A described in the third embodiment and in accordance with pilot pressure Pi (travel max)=max (Pi(right-hand travel), Pi(left-hand travel)) independently of whether only one of the traveling motors 2R and 2L is in operation or both are in operation. Then, the controller 45 supplies the traveling proportional valve 57 with the thus-determined energizing current and causes the unloading valve 56 for travel to operate.

In such a hydraulic system of this embodiment, when the traveling motors 2R and 2L are in operation, the bleed-off passages 27 in the direction control valves 22RR and 22LL associated with the energized traveling motors 2R and 2L are fully closed constantly, so that the center bypass passages 28 and 29 are cut off at the positions of the direction control valves 22RR and 22LL. Therefore, even if any of the working actuators 4 and 7~9 associated with any of the working direction control valves 23~26 located downstream of the direction control valves 22RR and 22LL which are associated with the energized traveling motors 2R and 2L is operated, the occurrence of pressure interference between the pressure oil fed to the traveling motors 2R, 2L and the pressure oil fed to the working actuators 4 and 7~9 is prevented. Then, by operating the unloading valve 56 for travel in the manner described above, there is made an appropriate bleed-off for the traveling motors 2R and 2L. Consequently, there can be attained the same functions and effects as in the third embodiment.

The other operations (including operation of the operating volume 46 and operation of the traveling bypass cut-off valves 53R and 53L in the boom and arm joining operations) than the above are the same as in the first embodiment.

In this embodiment, the traveling bypass cut-off valves 53R and 53L may be disposed at the positions of the cut-off valves 35 and 36 used in the first embodiment and illustrated in FIG. 1, or the cut-off valves 35 and 36 illustrated in FIG. 1 may be used as the traveling bypass cut-off valves 53R and 53L in this embodiment.

Figure 14A:
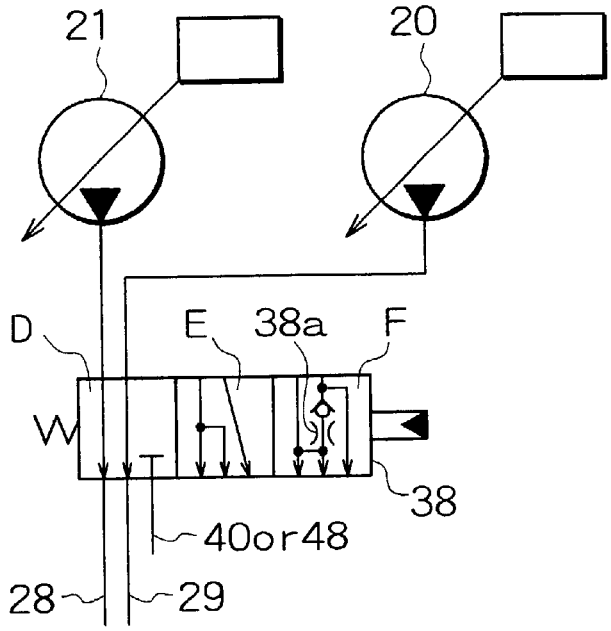
FIGS. 14A, 14B are diagrams showing other examples of straight-travel valves employable in the embodiments of the present invention.
Figure 14B:
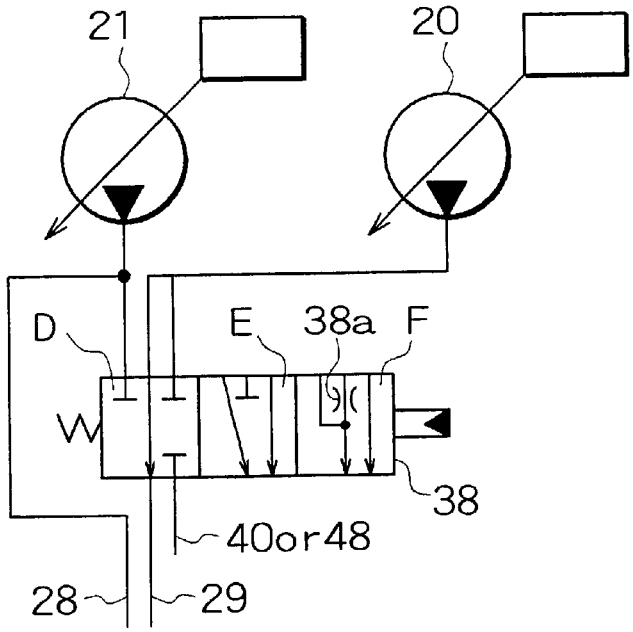

Although the straight-travel valve 38 of such a construction as shown in FIGS. 1, 8, 10, and 12 is used in the first to fourth embodiments, the straight-travel valve used in the present invention is not limited thereto. For example, there may be used a straight-travel valve of such a construction as shown in FIG. 14A or 14B. In FIGS. 14A and 14B, the same functional portions as in the previous embodiments are identified by the same reference numerals as in the previous embodiments. The straight-travel valves shown in both figures exhibit the same function as that of the straight-travel valve 38 used in the previous embodiments, and how to operate and control them may also be the same as in the previous embodiments.

In the above embodiments, when the traveling motor 2R or 2L and any of the working actuators 4 and 7~9 are operated simultaneously, a control characteristic (see FIG. 6A) for the pilot pressure Pi (travel max) in the straight-travel valve 38 is changed stepwise according to the amount of operation of the operating volume 46, but there may be adapted a modification in which when the operating volume 46 lies in its "ON" position for example and during operation of the traveling motor 2R or 2L, the straight-travel valve 38 is controlled constantly with such a characteristic as indicated by a dot-dash line "a" in FIG. 6A and is thereby held in its position E.

Moreover, although in the above embodiments the operating volume 46 is used for making the control characteristic of the straight-travel valve 38, etc. variable, the control characteristic of the straight-travel valve 38, etc. may be rendered variable by operating a two-stage control switch having only two operating positions corresponding to "OFF" and "ON" positions of the operating volume 46 or by driver's voice indication or the like.

Further, although in the third and fourth embodiments the working oil passage 48 is constructed in the same manner as in the second embodiment, there may be adapted such a working oil passage 40 as in the first embodiment. For example, in the fourth embodiment, in case of adopting the working oil passage 40 used in the first embodiment in place of the working oil passage 48, the unloading valve 50 for work, the working proportional valve 51 and the oil passage 52 used in the fourth embodiment are removed and the unloading valve 56 and the traveling bypass cut-off valves 53R and 53L are controlled in the manner described in the fourth embodiment. In case of performing the foregoing boom joining operation and arm joining operation, such cut-off valves 30 and 31 as those used in the first embodiment are disposed in the most downstream portions of the center bypass passages 28 and 29 and may be operated as described in the first embodiment.

Although embodiments of the present invention have been described above, the scope of protection of the invention is not limited thereto.

We claim:

1. A hydraulic system for a construction machine, comprising:

a first traveling motor and a second traveling motor adapted to actuate a pair of travel devices;

actuators adapted to actuate working attachments including a boom and an arm;

a first hydraulic pump and a second hydraulic pump adapted to supply pressure oil for actuating said first and second traveling motors and said actuators;

a first traveling control valve and a second traveling control valve adapted to control amount of pressure oil to be supplied to said first and second traveling motors in accordance with operation of operating means for the first and second traveling motors;

working control valves provided correspondingly to said actuators, said working control valves being classified into a first group including said first traveling control valve and a second group including said second traveling control valve, bleed-off passages in all the control valves belonging to said first group being mutually communicated in series as a first center bypass passage toward an oil tank when all the control valves are in their neutral positions, and bleed-off passages in all the control valves belonging to said second group being mutually communicated in series as a second center bypass passage toward an oil tank when all the control valves are in their neutral positions;

a straight-travel valve adapted to switch each flowing direction of pressure oil discharged from said first and second hydraulic pumps, said straight-travel valve supplying pressure oil discharged from said first and second hydraulic pumps to said first and second bypass passages respectively when all of said traveling motors and said actuators are not in operation, while in a simultaneous operation mode in which the traveling motor and the actuator associated with the traveling control valve and the working control valve belonging to one of said first and second groups are operated simultaneously, supplying pressure oil discharged from one of said first and second hydraulic pumps to both said first and second traveling control valves and further supplying pressure oil discharged from the other hydraulic pump to the working control valve; and a cut-off valve and an opening valve provided on a downstream side of each of the bleed-off passages in said traveling control valves, said cut-off valve cutting off the center bypass passage located between the traveling control valve and the working control valve associated with the traveling motor and the actuator which are in operation in said simultaneous operation mode of the traveling motor and the actuator being operated simultaneously, said opening valve causing a downstream side of the bleed-off valve in said traveling control valve to be opened to the oil tank.

2. The hydraulic system according to claim 1, further comprising:

a controller adapted to operate said cut-off valve, said controller making control so that when only one of said traveling motors is operated and in said simultaneous operation mode of the traveling motor and the actuator being operated simultaneously, the center bypass passage corresponding to the other traveling motor is cut off by said cut-off valve.

3. The hydraulic system according to claim 1, further comprising:

a controller adapted to control said opening valve, said controller, when all of said actuators are not in operation and said first or said second traveling motor is in operation, controlling said cut-off valve so that the center bypass passage located between the bleed-off passage in the traveling control valve associated with the traveling motor in operation and the working control valve located downstream thereof is cut off, and causing the downstream side of the bleed-off passage in said traveling control valve to be opened to the oil tank.

4. The hydraulic system according to claim 1, wherein said opening valve and said cut-off valve are constituted by an integrally constructed control valve as unit.

5. The hydraulic system according to claim 1, wherein said straight-travel valve is a control valve having a first operating position for conducting pressure oil from said first and second pumps independently and respectively to said first and second traveling control valves, a second operating position for conducting pressure oil from one of said first and second pumps to only both said traveling control valves and conducting pressure oil from the other pump to only said working control valves, and a third operating position for providing communication through a throttle valve between an oil passage communicating with both said traveling control valves in the second operating position and an oil passage communicating with the working control valves in the second operating position.

6. The hydraulic system according to claim 5, further comprising:

a controller, in said simultaneous operation mode of the traveling motor and the actuator being operated simultaneously, controlling said straight-travel valve to said second operating position when the amount of operation of operating means associated with the traveling motor in operation is not larger than a predetermined amount, while when the amount of operation of said operating means exceeds said predetermined amount, switching said straight-travel valve from said second operating position to said third operating position.

7. The hydraulic system according to claim 6, further comprising:

a controller, when all of said actuators are not in operation and said first or said second traveling motor is in operation, controlling said straight-travel valve to said second operating position when the amount of operation of the operating means associated with the traveling motor in operation is not larger than said predetermined amount, while when the amount of operation of said operating lever exceeds said predetermined amount, switching the straight-travel valve from said second operating position to said first operating position.

8. The hydraulic system according to claim 6, further comprising:

holding means adapted to hold said straight-travel valve in said second operating position by a predetermined operation in said simultaneous operation mode of the traveling motor and the actuator being operated simultaneously.

9. The hydraulic system according to claim 8, further comprising:

means which, in said simultaneous operation mode of the traveling motor and the actuator being operated simultaneously, adjusts the discharge rate of the hydraulic pump for the supply of pressure oil to the traveling motor in operation in accordance with the amount of operation of the operating means associated with said traveling motor, and means which sets variably, for said means of adjusting the discharge rate of the pump, a characteristic of a change in said discharge rate based on a change in the amount of operation of said operating means.

10. The hydraulic system according to claim 8, further comprising:

means which, in said simultaneous operation mode of the traveling motor and the actuator being operated simultaneously, adjusts the area of opening of said opening valve in accordance with the amount of operation of the operating means associated with the traveling motor in operation, and means which sets variably, for said means of adjusting the area of opening of the opening valve, a characteristic of a change in the area of opening based on a change in the amount of operation of said operating means.

11. The hydraulic system according to claim 1, wherein in said simultaneous operation mode of the traveling motor and the actuator being operated simultaneously, the oil passage for the supply of pressure oil discharged from one of said hydraulic pumps to said working control valves through said straight-travel valve is communicated with an inlet side of the bleed-off passage in each said working control valve located on an upstream side in each of said first and second groups and is also communicated with an inlet side of a meter-in passage in each of said working control valves in the first and second groups.

12. A hydraulic system for a construction machine, comprising:

a first traveling motor and a second traveling motor adapted to actuate a pair of travel devices;

actuators adapted to actuate working attachments;

a first hydraulic pump and a second hydraulic pump adapted to supply pressure oil for actuating said traveling motors and said actuators;

a first traveling control valve and a second traveling control valve adapted to control amount of pressure oil to be supplied to said first and second traveling motors in accordance with operation of operating means for the first and second traveling motors, bleed-off passages of said traveling control valves being fully open when said traveling control valves assume their neutral positions, and said bleed-off passages being fully closed when the traveling control valves assume their non-neutral positions;

working control valves provided correspondingly to said actuators, said working control valves being classified into a first group including said first traveling control valve and a second group including said second traveling control valve, bleed-off passages in all the control valves belonging to said first group being mutually communicated in series as a first center bypass passage toward an oil tank when all the control valves are in their neutral positions, and bleed-off passages in all the control valves belonging to said second group being mutually communicated in series as a second center bypass passage toward an oil tank when all the control valves are in their neutral positions;

a straight-travel valve adapted to switch each flowing direction of pressure oil discharged from said first and second hydraulic pumps, said straight-travel valve supplying pressure oil discharged from said first and second hydraulic pumps to said first and second bypass passages respectively when all of said traveling motors and said actuators are not in operation, while in a simultaneous operation mode in which the traveling motor and the actuator associated with the traveling control valve and the working control valve belonging to one of said first and second groups are operated simultaneously, supplying pressure oil discharged from one of said first and second hydraulic pumps to both said first and second traveling control valves and supplying pressure oil discharged from the other hydraulic pump to the working control valve;

an opening valve which, when said first or said second traveling motor is in operation, causes the oil passage located between the traveling control valve associated with the traveling motor in operation and the hydraulic pump for supply of pressure oil to said traveling control valve to be opened to the oil tank; and means which makes control so that the area of opening of said opening valve becomes smaller with an increase in the amount of operation of operating means for said traveling motor.

13. The hydraulic system according to claim 12, wherein:

said straight-travel valve is a control valve having a first operating position for conducting pressure oil from said first and second pumps independently and respectively to said first and second traveling control valves, a second operating position for conducting pressure oil from one of both said pumps to only both said traveling control valves and conducting pressure oil from the other pump to only said plural working control valves, and a third operating position for providing communication through a throttle valve between an oil passage communicating with both said traveling control valves in the second operating position and an oil passage communicating with the working control valves in the second operating position.

14. The hydraulic system according to claim 13, further comprising:

a controller which, in said simultaneous operation mode of the traveling motor and the actuator being operated simultaneously, controls said straight-travel valve to said second operating position when the amount of operation of the operating means associated with the traveling motor which is in operation is not larger than a predetermined amount, while when the amount of operation of said operating means exceeds said predetermined amount, switches said straight-travel valve from said second operating position to said third operating position.

15. The hydraulic system according to claim 14, further comprising:

a controller which, when all of said actuators are not in operation and said first or said second traveling motor is in operation, controls said straight-travel valve to said second operating position when the amount of operation of the operating means associated with the traveling motor which is in operation is not larger than said predetermined amount, while when the amount of operation of said operating means exceeds said predetermined amount, switches said straight-travel valve from said second operating position to said first operating position.

16. The hydraulic system according to claim 14, further comprising:

holding means which, in said simultaneous operation mode of the traveling motor and the actuator being operated simultaneously, holds said straight-travel valve in said second operating position by a predetermined operation.

17. The hydraulic system according to claim 14, further comprising:

means which, in said simultaneous operation of the traveling motor and the actuator being operated simultaneously, adjusts the discharge rate of the hydraulic pump for the supply of pressure oil to the traveling motor in operation in accordance with the amount of operation of the operating means associated with said traveling motor, and means which sets variably, for said means of adjusting the discharge rate of the hydraulic pump, a characteristic of a change in said discharge rate based on a change in the amount of operation of said operating means.

18. The hydraulic system according to claim 14, further comprising:

means which, in said simultaneous operation mode of the traveling motor and the actuator being operated simultaneously, adjusts the area of opening of said opening valve in accordance with the amount of operation of the operating means associated with the traveling motor in operation, and means which sets variably, for said means of adjusting the area of opening of the opening valve, a characteristic of a change in the area of opening based on a change in the amount of operation of said operating means.

19. The hydraulic system according to claim 12, wherein in said simultaneous operation mode of the traveling motor and the actuator, the oil passage for the supply of pressure oil discharged from one of said hydraulic pumps to said working control valves through said straight-travel valve is communicated with an inlet side of the bleed-off passage in each said working control valve located on an upstream side in each of said first and second groups and is also communicated with an inlet side of a meter-in passage in each of said working control valves in the first and second groups.

* * * * *